US006463748B1

(12) United States Patent
Benedict et al.

(10) Patent No.: US 6,463,748 B1
(45) Date of Patent: Oct. 15, 2002

(54) APPARATUS AND METHOD FOR CONTROLLING A MAGNETIC BEARING CENTRIFUGAL CHILLER

(75) Inventors: Scott M. Benedict, Orlando; Greg S. Cole, Ormond Beach, both of FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 09/455,475

(22) Filed: Dec. 6, 1999

(51) Int. Cl.[7] ..... F25B 49/02
(52) U.S. Cl. ..... 62/228.1; 62/228.4
(58) Field of Search ..... 62/228.5, 217, 62/209, 208, 228.4, 228.3, 228.1

(56) References Cited

U.S. PATENT DOCUMENTS 4,389,849 A 6/1983 Gasser et al. ..... 62/6
5,857,348 A 1/1999 Conry ..... 62/217 X

OTHER PUBLICATIONS

Steve Weeks, Magnetic Bearings Break Down Market Barriers, Expand Horizons, Sep. 20, 1999, pp. 16–17.
York Spotlights ML Compressor Magnetic Bearing System at Technology Conference, Jan. 28, 1999, pp. 1–2.

*Primary Examiner*—Harry B. Tanner
(74) *Attorney, Agent, or Firm*—Crowell & Moring LLP

(57) ABSTRACT

A control system and a method for controlling a centrifugal chiller through which a fluid to be chilled passes includes a chilling apparatus having at least one of each of the following components; an evaporator, a compressor, preferably a magnetic bearing compressor, a condenser and an expansion device. A plurality of sensors measure and generate signals representing operating conditions within the chilling apparatus. A chiller control unit including a signal processor receives the signals generated by the plurality of sensors. The chiller control unit further includes a memory device that stores information relating to thermodynamic properties of specific fluids and a comparison device programmed with a comparison algorithm that compares the received signals generated by the plurality of sensors to thermodynamic properties of the specific fluid contained in the memory device. Based on the comparison, the control unit generates at least one control signal to vary operation of one or more of the evaporator, compressor, condenser and expansion device to ensure the chiller system is operating at maximum efficiency.

21 Claims, 19 Drawing Sheets

| CHILLER CONTROLLER SIGNAL CONNECTIONS | | | | | | |
|---|---|---|---|---|---|---|
| CHANNEL | VARIABLE | SYMBOL | SENSOR | SIGNAL | RANGE | UNITS |
| ACH0 | COMPRESSOR SUCTION TEMPERATURE | $T_{suction}$ | | | | |
| ACH1 | COMPRESSOR DISCHARGE TEMPERATURE | $T_{discharge}$ | | | | |
| ACH2 | CONDENSER TEMPERATURE | $T_c$ | | | | |
| ACH3 | CONDENSER INLET WATER TEMPERATURE | $T_{cw\ inlet}$ | | | | |
| ACH4 | CONDENSER OUTLET WATER TEMPERATURE | $T_{cw\ outlet}$ | | | | |
| ACH5 | EVAPORATOR TEMPERATURE | $T_e$ | | | | |
| ACH6 | EVAPORATOR INLET WATER TEMPERATURE | $T_{ew\ inlet}$ | | | | |
| ACH7 | EVAPORATOR OUTLET WATER TEMPERATURE | $T_{ew\ outlet}$ | | | | |
| ACH8 | LIQUID LINE TEMPERATURE | $T_{ll}$ | | | | |
| ACH9 | CONDENSER PRESSURE | $P_c$ | | | | |
| ACH10 | EVAPORATOR PRESSURE | $P_e$ | | | | |
| ACH11 | CONDENSER WATER FLOW RATE | $M_{cw}$ | | | | |
| ACH12 | EVAPORATOR WATER FLOW RATE | $M_{ew}$ | | | | |
| ACH13 | INLET GUIDE VANE POSITION | $X_{IGV}$ | | | | |
| ACH14 | DIFFUSER VANE POSITION | $X_{DV}$ | | | | |
| ACH15 | REFRIGERANT FLOW RATE | $M_{ref}$ | | | | |

FIG.2

| CHILLER CONTROLLER / ASD SIGNAL CONNECTION | | | | | | |
|---|---|---|---|---|---|---|
| LINE | VARIABLE | TYPE | DIRECTION | | 0 | 1 |
| DIO2 | AFD ENABLE/QStop | DIGITAL | OUTPUT | | ENABLE | QStop |
| DIO3 | AFD START/STOP | DIGITAL | OUTPUT | | START | STOP |
| PB0 | AFD ALARM OR WARNING | DIGITAL | INPUT | | OK | ALARM |
| PB1 | AFD UNIT READY REMOTE CONTROL | DIGITAL | INPUT | | NOT READY | READY |
| | COMPRESSOR SPEED | RS-485 | INPUT/OUTPUT | | | |
| | MOTOR CURRENT (LINE) | RS-485 | INPUT/OUTPUT | | | |
| | MOTOR VOLTAGE (LINE) | RS-485 | INPUT/OUTPUT | | | |
| | REAL POWER | RS-485 | INPUT/OUTPUT | | | |
| DAC0 | AFD SPEED REFERENCE | ANALOG | OUTPUT | | | |
| | | | | | | |

FIG.3

| CHILLER CONTROLLER / MAG BEAR CONTROL UNIT SIGNAL CONNECTIONS | | | | | | |
|---|---|---|---|---|---|---|
| LINE | VARIABLE | TYPE | DIRECTION | | 0 | 1 |
| DI04 | ACK | DIGITAL | OUTPUT | | RESET | NO RESET |
| DI05 | OnReq | DIGITAL | OUTPUT | | LEVITATE | NO LEV. |
| PB2 | RLEV | DIGITAL | INPUT | | DON'T LEV | OK TO LEV |
| PB3 | LCOMP | DIGITAL | INPUT | | NOT LEV | LEV COMP |
| PB4 | MSTART | DIGITAL | INPUT | | DON'T STRT | OK TO STRT |
| PB5 | WARNING | DIGITAL | INPUT | | OK | WARNING |
| PB6 | SDOWN | DIGITAL | INPUT | | OK | ALARM |
| PB7 | SFAIL | DIGITAL | INPUT | | OK | ALARM |
| PC0 | DSP FAIL | DIGITAL | INPUT | | OK | ALARM |
| | TUNING AND ANALYSIS | RS-232 | INPUT/OUTPUT | | | |
| | | | | | | |

FIG.4

VARIABLE DEFINITIONS

CONTROL VARIABLES

| | | |
|---|---|---|
| N | COMPRESSOR SPEED | $0-N_{MAX}$ RPM |
| IGV | INLET GUIDE VANE ANGLE | 15–85° |
| DIF | DIFFUSER VANE ANGLE | 25–55° |
| dN | COMPRESSOR SPEED ADJUSTMENT | |
| dIGV | INLET GUIDE VANE ANGLE ADJUSTMENT | |
| dDIF | DIFFUSER VANE ANGLE ADJUSTMENT | |
| $N_{NEW}$ | NEW COMPRESSOR SPEED | |
| $IGV_{NEW}$ | NEW INLET GUIDE VANE ANGLE | |
| $DIF_{NEW}$ | NEW DIFFUSER VANE ANGLE | |
| $PID_{()}$ | PID CONTROL FUNCTION | |

OPERATING STATE VARIABLES

| | |
|---|---|
| PC | NON-DIMENSIONAL PRESSURE COEFFICIENT |
| FC | NON-DIMENSIONAL FLOW COEFFICIENT |
| EC | NON-DIMENSIONAL EFFICIENCY COEFFICIENT (ISENTROPIC EFFICIENCY |
| $PC_S$ | SURGE PRESSURE COEFFICIENT |
| $FC_S$ | SURGE FLOW COEFFICIENT |
| $S_{()}$ | SURGE LINE FUNCTION |

PLANT VARIABLES

| | |
|---|---|
| $LWT_M$ | LEAVING WATER TEMPERATURE MEASUREMENT |
| $LWT_S$ | LEAVING WATER TEMPERATURE SETPOINT |
| $LWT_E$ | LEAVING WATER TEMPERATURE ERROR |
| $LWT_B$ | LEAVING WATER TEMPERATURE ERROR BAND |

ITERATION COUNTER VARIABLES

| | |
|---|---|
| $C_{IGV}$ | IGV FULL OPEN COUNTER |
| $C_{RANGE}$ | LWT OUT OF RANGE COUNTER |
| $C_{SURGE}$ | SURGE CURVE ADJUSTMENT COUNTER |
| $C_S$ | SURGE DELAY COUNTER |
| $B_N$ | SPEED ADJUSTMENT BACKGROUND COUNTER |
| $B_{DIF}$ | DIFFUSER ADJUSTMENT BACKGROUND COUNTER |

OPERATING FLAG VARIABLES

| | |
|---|---|
| RANGE | LWT RANGE FLAG |
| RUN | COMPRESSOR RUNNING FLAG |
| ALARM | ALARM CONDITION FLAG |
| SURGE | SURGE FLAG |
| NAD | SPEED ADJUSTMENT MODE FLAG |
| IDAD | IGV/DIF ADJUSTMENT MODE FLAG |
| $NoN_{DEC}$ | SPEED REDUCTION FLAG |

MISCELLANEOUS VARIABLES

| | |
|---|---|
| $G_{IGV-N}$ | IGV / N GAIN FACTOR |
| $G_{IGV-DIF}$ | IGV / DIF GAIN FACTOR |

FIG.5

MAIN CONTROL SUBROUTINE

```
*** initialize program constants and variables ***
C_IGV=0, C_SURGE=0, C_RANGE = 0, C_S = 500
B_N = 500, B_DIF = 50
RANGE = 1, RUN = 0, ALARM = 0, SURGE = 0
NAD = 0, IDAD = 1
LWTs = 4.4 °C, LWTb = 0.5 °C
N = N_DES, IGV = IGV_DES, DIF = DIF_DES
dN = 0, dIGV = 0, dDIF = 0
G_IGV-N = x, G_IGV-DIF = y
LASTRUN = 0
NoN_DEC = 1
IGV_MAX = 15°, IGV_MIN = 85 °, DIF_MAX = 25°, DIF_MIN = 55°, N_MAX = 80000
dPC_MIN = 0.01, dFC_MIN = 0.01
N_JUMP = 0
*** initialize surge line arrays of data ***
start
*** determine current running state and desired running state ***
LASTRUN = RUN
if (RUN = 1) then
  measure LWTm
  LWTe = LWTm - LWTs
  if LWTe > LWTb then
    if LWTe > 0 then
      RANGE = 0
      C_RANGE = C_RANGE + 1
    elseif LWTe < 0 then
      RANGE = 1
      C_RANGE = 0
      RUN = 0
    endif
  elseif LWTe < LWTb then
    RANGE = 1
    C_RANGE = 0
  endif
elseif (RUN = 0) then
  measure LWTm
  LWTe = LWTm - LWTs
  if LWTe > LWTb then
    if LWTe > 0 then
      RUN = 1
      RANGE = 0
      C_RANGE = C_RANGE + 1
    elseif LWTe < 0 then
      RANGE = 1
      C_RANGE = 0
    endif
  elseif LWTe < LWTb then
    RANGE = 1
    C_RANGE = 0
  endif
```

FIG.9a

```
endif
if (LASTRUN - RUN = 0) then
  (do nothing)
elseif (RUN > 0) then
  N = N_DES, IGV= IGV_DES, DIF=DIF_DES
  levitate magnetic bearings
  start compressor subroutine
  delay 3 seconds
elseif (RUN = 0) then
  N = 0, IGV = IGV_DES, DIF=DIF_DES
  stop compressor subroutine
  delevitate magnetic bearings
  delay 3 seconds
endif
if (RUN) then
*** store previous measurements for efficiency optimaization ***
  store vars (IGV,DIF,N,FC,PC,EC) as (IGV_OLD,DIF_OLD,N_OLD,FC_OLD,PC_OLD, EC_OLD)
*** measure and calculate current operating state ***
  measure compressor T_in and P_in
  calculate compressor p_in and h_in and s_in
  measure compressor T_out and P_out
  calculate compressor p_out and h_out and s_out
  calculate compressor isentropic state T_isen and p_isen and h_isen
  measure compressor discharge dP_dis
  calculate compressor m_comp
  measure compressor speed N

  calculate head coefficient PC ψ

  calculate flow coefficient FC φ

  calculate isentropic efficiency EC η_isen = (h_isen - h_in) / (h_out - h_in)
  measure entering water temperature EWTm
  measure evaporator dP_evap
  calculate evaporator m_evap
  calculate cooling load Q_evap = c * m_evap * (EWTm - LWTm)
  measure real electrical power P_real

  calculate real efficiency η_real = P_real / Q_evap
*** determine surge condition of compressor ***
  sample electrical current I_real

  calculate mean current μ_real and standard deviation σ_real

  if ( σ_real > c) then
    SURGE = 1
    write calculated PC and FC to surge points array

  elseif ( σ_real < c) then
    SURGE = 0
  endif
*** check alarm conditions ***
  if (evaporator pressure < Pmin) ALARM = 1
  if (condenser pressure > Pmax) ALARM = 1
  if (motor temperature < Tmax) ALARM = 1
  if (AFD Alarm/Warn = 1) ALARM = 1
  if (MBU Shutdown = 1) ALARM = 1
*** shut down on alarm ***
  if (ALARM = 1) then
    RUN = 0
    N = 0, IGV = IGV_DES, DIF=DIF_DES
    stop compressor subroutine
```

FIG.9b

```
    delevitate magnetic bearings
    delay 3 seconds
  endif
*** determine distances from surge line in flow coeff and head coeff ***
  calculate surge pressure coefficient PCs using surge line function
  calculate surge flow coefficient FCs using surge line function
*** calculate adjustments and new positions ***
  call PID controller subroutine to calculate IGV_NEW from LWTe
  IGV_NEW - IGV = dIGV
  dDIF = G_IGV-DIF * dIGV
  dN = G_IGV-N * dIGV
  N_NEW = N + dN
  DIF_NEW = DIF + dDIF
*** check adjustment limits ***
if (IGV_NEW > IGV_MAX) then IGV_NEW = IGV_MAX
if (IGV_NEW < IGV_MIN) then IGV_NEW = IGV_MIN
if (DIF_NEW > DIF_MAX) then DIF_NEW = DIF_MAX
if (DIF_NEW < DIF_MIN) then DIF_NEW = DIF_MIN
if (N_NEW > N_MAX) then N_NEW = N_MAX
if (N_NEW < 0.15*N_MAX) then N_NEW = 0.15*N_MAX
*** select operating mode ***
  if (IDAD = 1) then
    call angle adjustment subroutine
  elseif (NAD = 1) then
    call speed adjustment subroutine
  endif

if (ALARM = 1) then
  exit program
elseif (ALARM = 0) then
  goto start
endif
```

FIG.9c

IDAD CONTROL SUBROUTINE

```
*** decrement speed downcounter ***
if (B_N > 0) then B_N = B_N - 1
*** decrement diffuser adjustment downcounter ***
if (B_DIF > 0) then B_DIF = B_DIF - 1
*** if IGV partially open and speed downcounter has reset to 0, OK to decrease speed ***
if (IGV_NEW < 0.85*IGV_MAX & B_N = 0)
  NoN_DEC = 0
else
  NoN_DEC = 1
endif
*** if IGV fully open, not OK to decrease speed
if (IGV_NEW = IGV_MAX) then
  C_IGV = C_IGV + 1
  NoN_DEC = 1
else
  C_IGV = 0
endif
*** if IGV fully open, increase speed unless cooling capacity is max at max speed ***
if (C_IGV > 5 & N < N_MAX) then
  NAD = 1, IDAD = 0
  N_JUMP = 0.5*N_MAX
  NoN_DEC = 0
  C_IGV = 0
  B_N = 500
else
  if (C_IGV > 5) then
    C_RANGE = 0
  endif
endif
*** revise surge line position ***
if (C_SURGE > 0) then
  C_SURGE = C_SURGE - 1
elseif
  C_S = C_S - 1
  if (C_S = 0) then
    develop best fit curve through surge points array
    C_S = 500
  endif
endif
if (SURGE = 1) then
  IDAD = 1, NAD = 0
  N = N + 0.04*N
  if (N > N_MAX) then
    N = N_MAX
  endif
  update N
  C_SURGE = 500
  C_RANGE = 0
  C_IGV = 0
  B_N = 500
  NoN_DEC = T
else if (SURGE = 0)
*** reset speed downcounter if it has reached zero ***
  if (B_N = 0) then B_N = 500
```

FIG.10a

```
  if (RANGE = 1 & C_RANGE > 5) then
*** decrease speed to improve efficiency ***
    if (NoN_DEC = 0 & (PCs-PC)>dPC_MIN) then
      if (ABS(N_NEW - N) > 0.02*N) then
        N = N - 0.02*N
      else
        N = N_NEW
      endif
      update N
*** change diffuser angle to improve efficiency ***
    elseif(B_DIF = 0) then
      B_DIF = 50
*** compare efficiencies change to determine sign of diffuser gain constant ***
      if (EC < EC_OLD) then
        DIF_NEW = DIF - dDIF
        DIF = DIF_NEW
        update DIF
      elseif (EC > EC_OLD) then
        DIF = DIF_NEW
        update DIF
      endif
    endif
  elseif (RANGE = 0) then
    IGV = IGV_NEW
    update IGV
  endif
```

FIG.10b

NAD CONTROL SUBROUTINE

```
*** if inlet guide vanes are substantially closed, change to angle mode ***
if (IGV < 0.7 * IGV_MAX) then
  IDAD = 1, NAD = 0
  B_N = 500
  NoN_DEC = 1
endif
*** if speed max and IGV full open, change to angle mode ***
if (N = N_MAX & IGV > 0.99*IGV_MAX) then
  N_JUMP = 0.99*N_MAX
endif
if (SURGE = 1)
  IDAD = 1, NAD = 0
  N = N + 0.04*N
  if (N > N_MAX) then
    N = N_MAX
  endif
  update N
  C_SURGE = 500
  C_RANGE = 0
  C_IGV = 0
  B_N = 500
  NoN_DEC = T
elseif (SURGE = 0) then
  if (N_NEW < N & NoN_DEC = 1) then
    N_NEW = N
  else
    if (ABS(N_NEW - N) > 0.02*N) then
      if (N_NEW > N) then
        N_NEW = N + 0.02*N
      elseif (N_NEW < N) then
        N_NEW = N - 0.02*N
      endif
    endif
  endif
  if (N_NEW < N_JUMP) then
    IDAD = 1, NAD = 0
    B_N = 500
    NoN_DEC = 1
    N_NEW = N_JUMP
  elseif (N_NEW > N_JUMP)
    N = N_NEW
  endif
  if (NoN_DEC = 1 & dIGV < 0) then
    IGV = IGV_NEW
    update IGV
  endif
update N
```

FIG.11

APPARATUS AND METHOD FOR CONTROLLING A MAGNETIC BEARING CENTRIFUGAL CHILLER

BACKGROUND OF THE INVENTION

The invention relates generally to an apparatus and method for controlling the operation of a centrifugal chiller refrigeration system. More particularly, the chiller control system of the present invention operates a centrifugal chiller which possesses both a magnetic bearing centrifugal compressor and an adjustable speed motor drive. Additionally, the present invention discloses the necessary components and control logic for use with the chiller control system.

A centrifugal chiller typically consists of the following components: one or more evaporators, compressors, condensers and expansion devices. In a chiller, the compressor acts as a vapor pump, where raising the pressure of the refrigerant from the evaporating pressure to the condensing pressure provides an active means of absorbing heat from a lower temperature environment and rejecting that heat to a higher temperature environment. As an active machine, the chiller requires an apparatus to control its operation.

In general terms, a centrifugal compressor for a chiller typically consists of the following components: inlet guide vanes, one or more impellers within a housing surrounded by one or more diffusers with collectors driven by some mechanical shaft means, such as for example, an electric motor. The mechanical shaft means is supported by one or more bearings of the rolling element, journal, or magnetic bearing type which accommodate both radial and axial loads. In variable speed electric chillers, the centrifugal compressor is supplied with electrical power through an adjustable speed motor drive which alters the frequency and/or voltage of the power to the motor to modulate the speed of the compressor.

The chiller control system for a centrifugal chiller typically performs one or more of the following functions: adjust inlet guide vane position and/or compressor speed to match the cooling capacity with the cooling load, monitor chiller operating conditions for unsafe operation and take appropriate action when encountered, display chiller operating conditions for user interpretation, and/or operate the chiller in response to a predefined schedule.

Chiller control systems of the microprocessor type typically consist of one or more of the following devices, a microprocessor which runs a control algorithm, sensors which acquire operating data from one or more points on the chiller, display devices for communicating information on chiller operating conditions and various devices for the input of information to the chiller control system. While these chiller control systems have performed adequately for centrifugal chillers consisting of compressors with rolling element bearings and/or journal bearings, they are inadequate for chillers with magnetic bearing centrifugal compressors.

Rolling element bearings are generally passive devices and, during normal operation, operate without the requirement of active control. The chiller control system does not typically provide active control of the rolling element bearings where, in this context, active implies continual adjustment of some bearing feature. Chiller control systems for centrifugal chillers which use rolling element bearings in the compressor may monitor the bearing temperature, at periodic intervals, as an indication of whether the machine is operating properly. An elevated temperature is used as an indication of a potential mechanical problem with the bearings. If the measured bearing temperature exceeds a predefined setpoint, the chiller control system may be programmed to stop the machine and alert the user.

In magnetic bearing centrifugal compressors, the compressor rotor is suspended on a magnetic field generated in the magnetic bearings. For definitional purposes, "magnetic bearings" are electromagnetic devices used for suspending a rotating body in a magnetic field without mechanical contact. The bearings can be further classified as active, indicating that some type of active control system is necessary to ensure stable levitation of the rotating body.

Distinct from other compressor types, a magnetic bearing centrifugal compressor uses magnetic bearings as the primary means for supporting the rotor structure. There is a clearance gap between the rotating and stationary components of the bearing that is measurable and controllable. For the magnetic bearings to operate properly, electrical power and proper operation of the magnetic bearing control electronics are required.

As described previously, existing chiller control systems for centrifugal chillers do not work adequately for centrifugal chillers with active magnetic bearing centrifugal compressors. The necessary control strategies are not provided by the controllers known in the art.

Specifically, these chiller control systems do not monitor the magnetic bearings for stable levitation which is required in order to prevent damage to the magnetic bearing centrifugal compressor. Existing chiller control systems may allow the compressor to turn at high speeds while the magnetic bearings are not stably levitated. When this occurs, the rotor does not spin about a fixed axis. Rather, the rotor spins on. an axis contained within a small cylinder defined by the clearances between the compressor rotor assembly and the stationary compressor housing. The unconfined rotation of the compressor rotor assembly may generate large forces (due to the kinetic energy stored in the rotor at high speeds), and may thereby damage the magnetic bearings, the compressor rotor assembly, and compressor impeller, as well as the attached stationary compressor housing. In the event of a loss of active control of the compressor rotor, the rotor may contact the auxiliary bearings within the compressor.

Due to the disadvantages associated with chiller control systems known in the prior art for centrifugal chillers which have magnetic bearing centrifugal compressors, it should therefore be appreciated that there is a need for a chiller control system for a magnetic bearing centrifugal chiller.

In view of the foregoing, it is an object of the present invention to provide a chiller control system apparatus and method for controlling a centrifugal chiller which possesses a magnetic bearing centrifugal compressor and an adjustable frequency motor drive.

The function of a chiller control system is to operate a centrifugal chiller in such a manner as to meet the cooling load requirements. The chiller control system continuously monitors the cooling load and other chiller variables, and adjusts the operation of the chiller to match the cooling load. In sophisticated chiller control systems, in addition to matching cooling load, the control system seeks to operate the compressor in a manner that maximizes operating efficiency to reduce overall electrical power consumption.

While maximizing overall centrifugal chiller operating efficiency, the chiller control system must operate the magnetic bearing centrifugal compressor safely by avoiding compressor surge. Surge occurs when there are sudden reversals in the direction of fluid flow through the compressor impeller as the pressure difference across the impeller becomes too large. (Since additional static pressure rise occurs in the compressor diffuser as the fluid is decelerated, the pressure near the diffuser entrance may exceed the pressure at the impeller exit.)

When the impeller exit pressure drops below diffuser pressure, the fluid flow direction reverses and flows back into the compressor impeller, resulting in significantly increased stresses and a substantially increased vibration of the compressor rotor. The flow reversal causes the pressure at the impeller exit and within the diffuser to drop. When the pressure drops below the surge point, the flow again reverses direction and flows into the diffuser. A compressor operates in a surging condition when these sudden flow reversals are occurring. The flow reversals during surge damage the chiller equipment.

Prior experimental studies have shown that the maximum operating efficiency of a centrifugal compressor is close to the surge boundary. To minimize energy consumption, the impeller should not impart more energy to the fluid than necessary to meet the temperature lift requirements for the vapor compression refrigeration cycle. Any additional energy imparted to the refrigerant flow above the required amount is wasted. Maximum efficiency occurs near the surge boundary. Hence, to maximize the efficiency of a centrifugal chiller, the compressor should be operated at the lowest speed possible that is just great enough to avoid a surge condition. The location of the surge point is a function of the aerodynamic design of the centrifugal compressor.

During centrifugal compressor development, detailed measurements of the pressure rise versus flow rate behavior of the compressor at various operating speeds, inlet guide vane angle settings and diffuser vane angle settings are typically conducted. These measurements determine a surge line for the compressor, a plot of the points (flow coefficient, head coefficient) on the compressor operating map (where the non-dimensional head coefficient lies along the y-axis and the non-dimensional flow coefficient lies along the x-axis) where the surge condition is encountered. The compressor avoids a surging condition when its current operating state (defined by the calculated flow coefficient and head coefficient) lies below and to the right of the surge line on the compressor operating map. The operating envelope for the compressor is the complete set of points (flow coefficient, head coefficient) for which some combination of inlet guide vane angle, diffuser vane angle, and compressor speed will allow operation in a non-surge condition. This operating map for the compressor can be stored in the memory of the control system as a set of equations which define the surge line or as a set of points which form an array of stable operating states.

A surge condition can be detected by the chiller control system by changes in chiller performance. When the compressor is surging, the torque on the rotor oscillates (from positive to negative) which causes noticeable changes in the electrical current supplied to the motor element.

A surge condition can also be detected by the chiller control system by changes in the magnetic bearing operating conditions. When the compressor is surging, the rotor oscillates which causes noticeable changes in bearing position, stabilizing current, force and temperature.

The compressor head coefficient-flow coefficient operating map determines the safe operating condition (flow coefficient, head coefficient) for a particular cooling load and pressure lift requirement. The compressor head-flow operating map can be adjusted or modified, should changes occur over time in either the impeller surface finish, the diffuser vane condition or the impeller to shroud clearance.

The typical chiller control system adjusts the compressor speed, inlet guide vane position, and diffuser vane position to meet the pressure ratio requirements and the cooling load requirements while operating as efficiently as possible. Prior experimental research studies have shown that a coordinated adjustment of the inlet guide vanes and diffuser vanes can increase the operating efficiency of a centrifugal compressor impeller from 2 to 6 percent. Wallman et al., "Improvements in Performance Characteristics of Single-Stage and Multistage Centrifugal Compressors by Simultaneous Adjustments of Inlet Guide Vanes and Diffuser Vanes." *Transactions of the ASME Journal of Turbomachinery*, January 1987, Vol. 109, pgs. 41–47.

It is an object of the present invention to provide a chiller control system for centrifugal chillers which possess magnetic bearing centrifugal compressors.

It is another object of the present invention to provide a chiller control system for centrifugal chillers which possess adjustable speed motor drives.

It is yet another object of the present invention to prevent operation of the chiller in the event of a problem with the magnetic bearings, thereby preventing damage to the chiller compressor(s).

It is another object of the present invention to prevent operation of the magnetic bearings in the event of a problem with the centrifugal chiller electrical power supply, thereby prolonging magnetic bearing operating life.

Another object of the present invention is to provide a measurement of the electrical power consumption of the centrifugal chiller during operation, thereby eliminating the need for an external electrical power measurement device.

It is even another object of the present invention to provide a measurement of the centrifugal compressor operating speed.

It is yet another object of the present invention to provide a method of storing centrifugal chiller operating data over long periods of time to allow the assembly of energy usage studies.

It is still a further object of the present invention to provide an improved user interface for displaying operational parameters of the centrifugal chiller.

Yet another object of the present invention is to provide a chiller control system algorithm which controls the operation of inlet guide vane position, diffuser vane position, magnetic bearing position, and motor speed in order to maximize the chiller operating efficiency.

It is another object of the present invention to provide a method for measuring bearing forces, vibrations and imbalances in order to indicate the machine's condition, and predict problems and schedule maintenance.

SUMMARY OF THE INVENTION

These and other objectives and advantages are achieved by the chiller control system apparatus and method according to the invention. A centrifugal chiller, for which the preferred embodiment of the invention is applicable, consists of an evaporator, a magnetic bearing centrifugal compressor, a condenser, and an expansion device. The magnetic bearing centrifugal compressor increases the pressure of the refrigerant vapor from the saturation pressure of the refrigerant in the evaporator to the saturation pressure of the refrigerant in the condenser. A typical embodiment of the magnetic bearing centrifugal compressor, such as that described in co-pending patent application Ser. No. 08/908,035, filed Aug. 11, 1997, the specification of which is herein expressly incorporated by reference, contains a compressor rotor supported on both sides of the electric motor element by radial magnetic bearings of the type well known to those skilled in the art. Axial magnetic bearings located outside of each radial magnetic bearing absorb thrust loads. A microprocessor magnetic bearing control unit (MBU) provides active control of the magnetic bearings to maintain the compressor rotor in a stable levitated position at all operating speeds. The magnetic bearing centrifugal compressor is driven by an electric motor whose speed is controlled by a microprocessor adjustable speed motor drive (ASD).

In a preferred embodiment, the chiller control system apparatus consists of a microprocessor chiller controller (CC), an adjustable speed motor drive (ASD), and a magnetic bearing control unit (MBU). The chiller controller (CC) acquires, processes, records and analyzes operating data from the centrifugal chiller sensors. The chiller controller (CC) possesses both analog and digital input and output capabilities for data acquisition and control. Additionally, the chiller controller (CC) uses a touchscreen display for data input and output communication. The chiller controller (CC) runs a chiller control system algorithm (described later) that processes input sensor data and sends control signals to various other components of the chiller control system described herein.

The chiller controller (CC) communicates with the magnetic bearing control unit (MBU) through digital input and output signal lines and serial communications links. Through these lines, the CC provides commands to levitate and delevitate the magnetic bearings, monitors the operating status of the magnetic bearings, reads any alarm or warning conditions and accesses diagnostic and tuning functions. The chiller controller (CC) communicates with the adjustable speed motor drive (ASD) through both digital and analog input and output signals lines. Through these lines, the CC provides commands to stop and start the centrifugal chiller, signals the desired motor speed, monitors operating data, reads any alarm and/or warning conditions and accesses other control functions. It is through the analog input signal line of the ASD that the CC communicates the desired compressor operating speed to the ASD. The ASD then uses its internal microprocessor and PID algorithm to match actual compressor speed to the desired setpoint speed.

As critical components of the chiller control system, the MBU and the ASD are connected by pairs of incoming and outgoing signal lines. Through these lines, alarm and/or warning conditions are communicated instantly whenever they occur to the other component, thus allowing the microprocessor of the other component to take the appropriate action.

The CC actuates the inlet guide vanes through inlet guide vane position and feedback signals. The CC actuates the diffuser vanes through diffuser vane position and feedback signals. The position of the inlet guide vanes, the diffuser vanes, and the compressor operating speed are coordinated by a complex chiller control system algorithm that responds to input data from a variety of sensor signals which monitor operating conditions within the chiller. The chiller control system algorithm provides all monitoring, controlling and communicating functions.

The chiller control system algorithm according to the invention serves to operate the centrifugal compressor at the lowest speed possible with the inlet guide vanes and the diffuser vanes adjusted at an angle to maximize efficiency. Here, the chiller control system algorithm contains several loops that adjust the three main control parameters (inlet guide vane position, diffuser vane position, and compressor speed).

BRIEF DESCRIPTION OF THE DRAWINGS

Other objects, advantages and novel features of the present invention will become apparent from the following detailed description of the invention when considered in conjunction with the accompanying drawings, wherein:

FIG. 2 is a table of analog sensor connections to the chiller controller (CC) according to the invention;

FIG. 3 is a table of digital input/output connections between the adjustable speed motor drive (ASD) and the chiller controller (CC) according to the invention;

FIG. 4 is a table of the digital input/output connections between the magnetic bearing control unit (MBU) and the chiller controller (CC) according to the invention;

FIG. 5 is a partial list of variable definitions for the chiller control system algorithm according to the invention;

FIGS. 9(*a*)–9(*c*) illustrate an example of the source code for implementing the main program;

FIGS. 10(*a*) and 10(*b*) show an example of the source code for implementing the angle adjustment subroutine; and FIG. 11 shows an example of the source code for implementing the speed adjustment subroutine.

DETAILED DESCRIPTION OF THE DRAWINGS

Figure 1A:
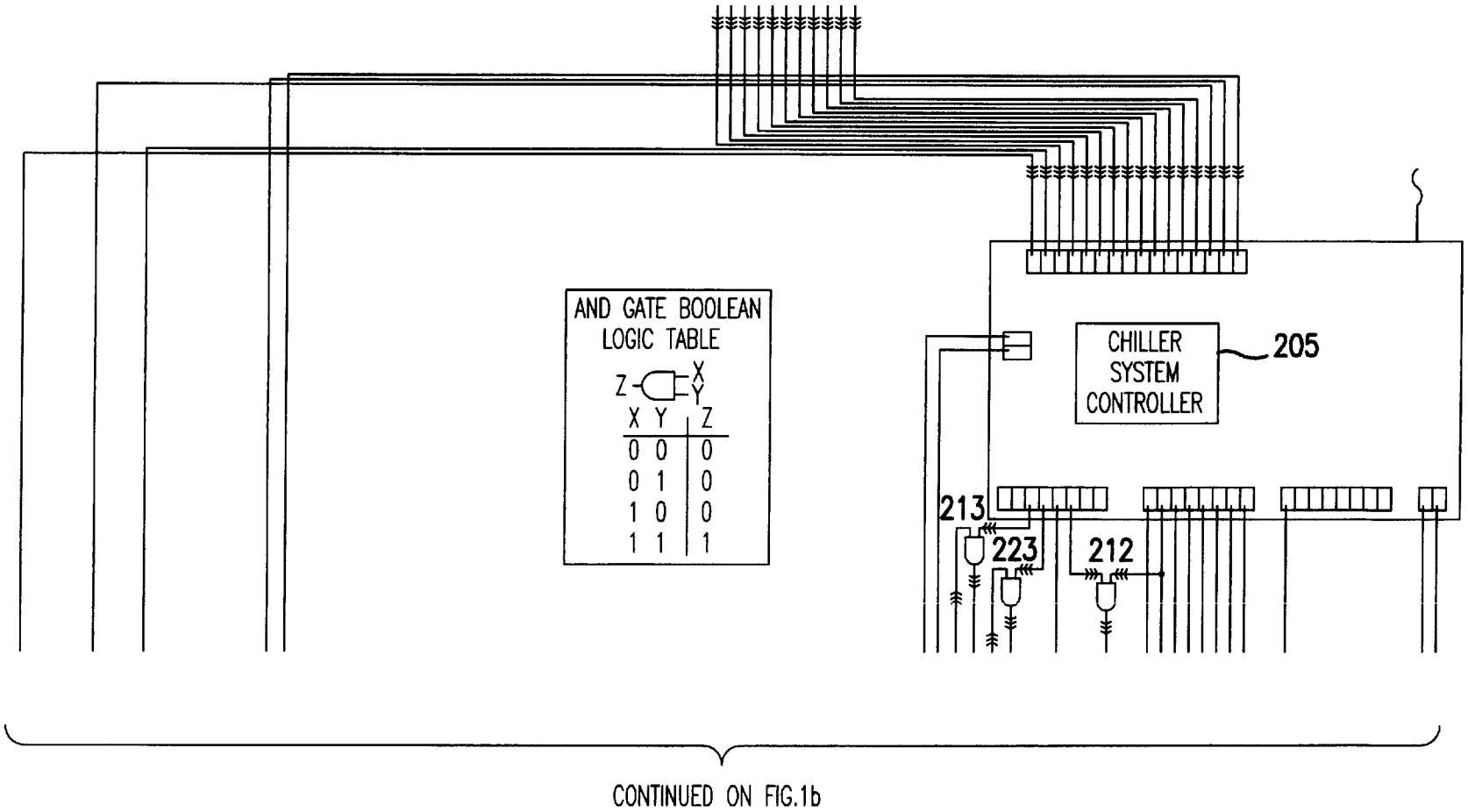
FIGS. 1*a* and 1*b* are schematic diagram of the chiller control system apparatus showing the major electrical and signal connections between the components according to the invention.
Figure 1B:
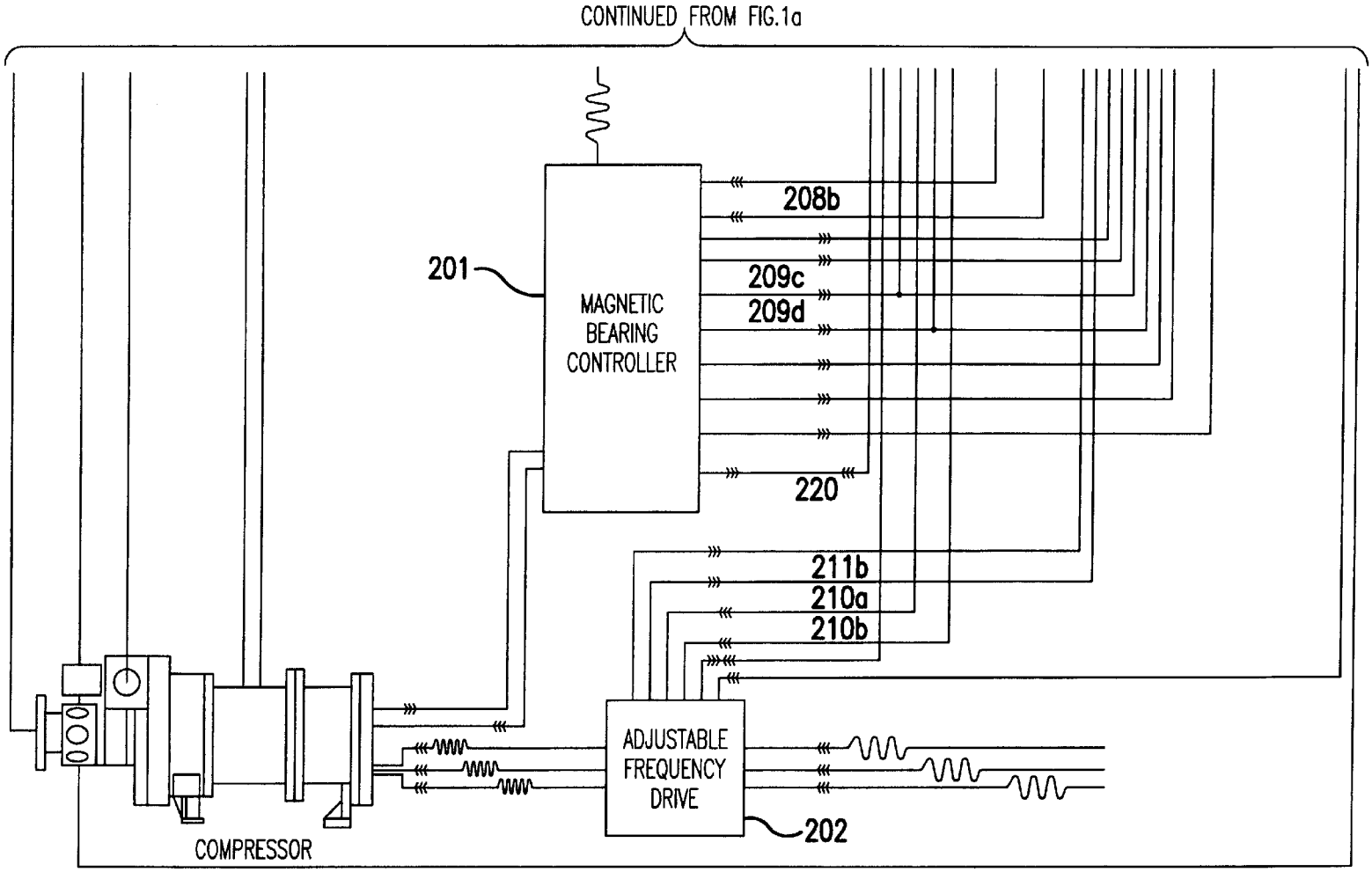
Figure 1C:
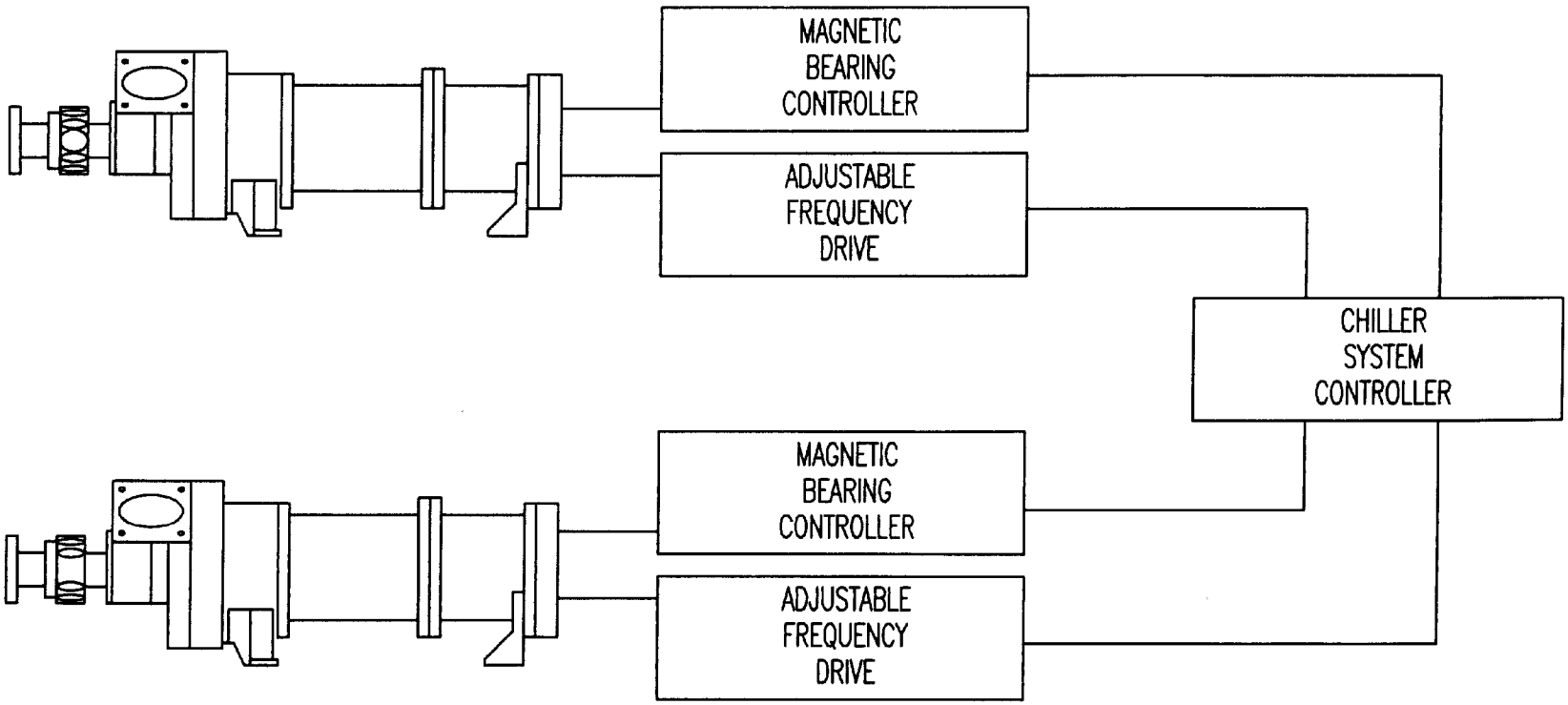
FIG. 1*c* is a schematic diagram of the chiller control system apparatus showing more than one centrifugal compressor.

A schematic diagram of the chiller control system apparatus is shown in FIGS. 1*a* and 1*b*. The chiller controller (CC) 205 is a microprocessor computer that forms the heart of the chiller control system apparatus. It operates the necessary software, the chiller control system algorithm (described later), to control a centrifugal chiller which has a magnetic bearing centrifugal compressor and an adjustable speed motor drive. The microprocessor computer has a disk drive for data storage and a touchscreen display for the interchange of information between the chiller user and the chiller control system apparatus. The touchscreen display (not shown) graphically presents information regarding the operating conditions and current status of the centrifugal chiller in a convenient format.

The chiller control system requires input data from several sources on which it makes judgements about its performance. Here, the chiller control system monitors the data at regularly scheduled intervals. Cooling load requirements are determined from the measured inlet and outlet water temperatures and the calculated water flow rate (based on the measured pressure drop within the evaporator heat exchanger). The compressor head rise is calculated from measured pressures at the inlet and exit of the compressor. Because of the computational capabilities of the control system, with knowledge of the refrigerant equations of state, the thermodynamic properties of the refrigerant can be calculated. From measurements of the temperatures and pressures at the inlet and exit of the compressor, the complete thermodynamic properties of the refrigerant, including enthalpy, entropy, and specific volume can be determined.

The compressor capacity for this control system is estimated from measurements of the water flow rate and measurements of the inlet and outlet chilled water temperatures in the evaporator. The flow rate through the evaporator is determined from measurements of the differential water pressure taken in the inlet and outlet chilled water lines. The measured pressure drop is correlated with the flow rate through the evaporator in its original clean condition. A curve showing the flow rate versus measured pressure drop for the evaporator is stored in the control system memory. The cooling capacity is calculated from the water flow rate, water specific heat, and the measured temperature difference from the inlet to the outlet of the evaporator.

The magnetic bearing control unit, MBU 201, of the type commonly known in the art, controls the levitation and operation of the magnetic bearings inside the centrifugal compressor.

The adjustable speed motor drive, ASD 202, the other main component of the chiller control system apparatus, of the type commonly known in the art, controls the speed of the compressor. All control and signal wiring is shielded from electromagnetic interference which typically radiates from adjustable speed motor drives.

The chiller controller, the microprocessor computer CC 205, contains a multi-function data acquisition and control card DAQ which can accommodate both analog and digital inputs and outputs. The chiller controller also has RS-485 and RS-232 serial communications capabilities. Through the DAQ board and serial communications, the chiller controller both acquires data from the other components and sends command signals to control their operation. The DAQ board contains analog input sensor channels, analog output control signals and digital input and output ports, which are wired to external relays and configured as digital switches. The inputs acquire data from temperature sensors, pressure transducers, and/or flow rate sensors which may be located at different points throughout the chiller. From the acquired data, the CC calculates the thermodynamic conditions of the refrigerant in the evaporator and condenser. In addition, the data is used to determine if the current operating state generates an alarm or warning to alert the user of potentially unsafe conditions. FIG. 2 is a table showing the typical sensor signals connected to the analog channels for a preferred embodiment of the invention.

The chiller control system apparatus contains signal conditioning electronics for the sensors. The signal conditioning electronics provide instrument grade power for the various sensors located throughout the centrifugal chiller. The signal conditioning electronics convert the high voltage signals from the magnetic bearing control unit (MBU) 201 and the adjustable speed motor drive (ASD) 202 into lower voltage signals which are readable by the DAQ board of the chiller controller (CC) 205.

Subroutines for determination of the refrigerant enthalpy, entropy, and specific volume as a function of measured pressure and temperature allow calculation of the isentropic efficiency of the compression process. The total real electrical power consumption is measured by the ASD 202.

Control systems, known in the prior art, typically use liquid crystal display LCD screens to display operating parameters and use keypads to input and output information. The control system apparatus of the present invention uses a touchscreen display, of the type known in the art, as the interface between the user and the chiller control system. A touchscreen display presents true graphics capabilities which allows the presentation of a larger quantity of information to the user than the that which is capable of being presented with smaller displays. The additional information simplifies the user's task of assessing chiller operating conditions. Both text based and graphics based information can be displayed simultaneously.

The chiller control system algorithm software has been configured to be menu and button driven, thereby preventing inadvertent changes to the chiller operating status by pressing the wrong panel switches.

Using a hard disk drive storage device, of the type well known in the art, provides the CC 205 with significant physical data storage capabilities. A hard disk drive permits the CC algorithm to write the chiller sensor, magnetic bearing, electrical power, cooling load and other chiller operating data to files which can be later retrieved for study of the energy usage pattern within the building. In contrast to the preferred embodiment of the invention, existing chiller control systems contain limited quantities of memory locations where alarm information and chiller data can be stored.

The chiller controller CC 205 communicates with the adjustable speed motor drive ASD 202 through a combination of analog control signals, digital inputs and outputs, as well as serial RS-485 communications. FIG. 3 is a table showing the connections between the CC 205 and the ASD 202 components.

The speed of the electric motor is controlled by an ASD 202 of a type well known in the art. Electrical power is supplied to the ASD 202 which can vary the motor speed from 0 RPM to a maximum design operating speed for the centrifugal chiller. The ASD is capable of continuous motor speed variation. The ASD has PID control capabilities to maintain the speed of the motor under varying load conditions. The feedback signal for the PID control is provided by a speed sensor which is mounted inside the electric motor. Utilizing the RS-485 protocol, the ASD 202 provides the capability of serial communication with the CC 205. Through the serial interface, adjustable speed motor drive operating parameters (such as line voltage, line current and real power consumption) can be read. In addition, the ASD 202 provides capabilities for both digital and analog signal inputs and outputs through which its operation can be controlled remotely.

The ASD 202 is wired to the CC 205 with a two wire start/stop configuration. The configuration consists of two lines, ENAB/QSTOP and START/STOP, which must both be ON before the adjustable speed motor drive will start the electric motor. The ENAB/QSTOP line provides emergency stop capabilities during an alarm condition. When the line is switched OFF, the ASD 202 reduces the motor speed to 0 RPM at the highest possible deceleration rate by using DC braking. When the START/STOP line is switched OFF, the ASD 202 reduces the electric motor speed to 0 RPM along a much slower and smoother deceleration curve. A normal STOP reduces the wear on the electric motor and ASD 202.

The ASD 202 has its own internal microprocessor controller and diagnostics system which monitors electrical and thermal conditions on both the incoming and outgoing electrical power lines and within the drive itself. The ASD 202 communicates its current status to the CC 205 through two electrical output relays (not shown). The READY/

REMOTE relay output indicates whether the ASD 202 is ready for operation. The ALARM/WARN relay output indicates whether the ASD 202 has encountered an alarm or warning condition. Alarm conditions indicate under or overvoltage on the power supply lines, overheating of either the ASD 202 or the electric motor, overcurrent conditions or failure of any internal electrical component. Alarm conditions result in an immediate shutdown of the ASD 202. Warning conditions indicate operating conditions that are out of normal preprogrammed limits. The warning conditions do not result in immediate shutdown, but typically indicate a problem that may need to be corrected.

The ASD varies the voltage and/or frequency of the outgoing electrical power to maintain the electric motor at a desired operating speed under load conditions or to track a desired acceleration/deceleration curve. The ASD microprocessor controller uses an internal PID algorithm with user programmable parameters to match the actual electric motor speed with a desired electric motor speed reference signal. Feedback of the actual motor speed to the ASD controller comes from a speed sensor which is mounted in the electric motor. The chiller controller determines the desired compressor speed for the centrifugal chiller based on the particular thermal conditions encountered during operation. The chiller controller communicates the desired compressor speed to the controller through an analog output signal line.

The ASD microprocessor controller records the supply voltage and line current, calculates real power and total energy consumption, calculates actual compressor speed from the feedback signal, monitors the total operating hours and records other important operating statistics during operation. The information is updated and stored in the available controller memory at regular intervals. The chiller controller retrieves the information through the RS-485 serial communications link and uses it to estimate the chiller kW/ton efficiency. The communications protocol to retrieve the information is programmed into the chiller control system algorithm.

Operation of the ASD controller and its response to input signals is directed through several groups of parameters stored in memory. These parameters can be accessed either locally at the ASD control panel, or remotely through the RS-485 serial communications link. For this application, the ASD control panel is disabled so that the preprogrammed parameters cannot be changed. The preprogrammed parameters are set for use with the chiller control system algorithm. For servicing and diagnostic purposes, the CC 205 also allows access to examine and change the ASD 202 parameters.

The CC 205 communicates with the magnetic bearing control unit MBU 201 through digital input and output lines during normal control system operation. During diagnostics and tuning procedures which are not performed during chiller operation, the CC 205 communicates with the MBU 201 through an RS-232 communications link. FIG. 4 is a table showing the digital input/output connections between the MBU 201 and the CC 205.

The magnetic bearing control unit MBU 201 comprises a microprocessor controller, a set of amplifier modules, and a DC power supply unit. Its basic function is to sequence the levitation and de-levitation operations for the magnetic bearings and to keep the magnetic bearings in a stable levitated position at all operating speeds. It monitors torque, alarm and warning conditions associated with bearing position, supply power, bearing force, bearing temperatures and shaft speeds. When alarm conditions occur, the magnetic bearing control unit activates the external input/output relay signals. The MBU has relay contacts on the back panel for remote operation through digital signals from an external controller.

The magnetic bearing control unit 201 contains the signal conditioning hardware necessary to sense the bearing position based on position sensor input, torque based on torque monitoring sensor input, a microprocessor controller to run the control algorithm to determine the response of the bearing to the change in shaft position, and a serial RS-232 interface for setting the tuning parameters, monitoring operations or accessing diagnostic functions. The power amplifier modules generate the high currents required to operate the bearings by amplifying the low voltage control signals from the microprocessor controller. The DC power supply unit converts typical AC line power into higher voltage DC power for use by the amplifiers.

The CC 205 communicates with the MBU 201 through digital input and output lines during normal operation. With the MBU 201 operating in automatic mode, when the ONREQ line is switched ON, if there are no preexisting alarm conditions, the MBU 201 begins the levitation sequence. The magnetic bearing control unit powers up and the microprocessor controller begins running the control algorithm. The amplifier modules are charged and then connected to the DC power supply unit. The amplifiers, after receiving the signal from the microprocessor controller, apply power to the magnetic bearings, causing the shaft to levitate to the neutral position. When the ONREQ line is switched OFF, the MBU 201 is given the command to begin the de-levitation sequence. However, the sequence does not actually begin until the shaft speed drops below a preprogrammed minimum safe operating speed. This prevents damage to the machine caused by the unpredictable shaft motion that occurs when a high speed rotor is suddenly lowered onto stationary auxiliary ball bearings. When the shaft reaches the minimum speed, the amplifiers, after receiving the signal from the microprocessor controller, reduce power to the magnetic bearings which causes the shaft to de-levitate and contact the auxiliary bearings. The amplifiers are disconnected from the DC power supply unit and the charge remaining in the amplifier capacitors slowly leaks to ground. The magnetic bearing control unit 201 is powered down, thus shutting off the microprocessor controller.

During the levitation sequence, digital outputs of the MBU 201 indicate the status of the sequence. The RLEV output indicates that the MBU 201 is powered up and ready to respond to a request for levitation. The CC 205 interprets the RLEV output as an indication that the unit is operating properly and that it can be safely started.

The LCOMP output indicates that the levitation sequence has been started. The CC 205 interprets the output as an indication that the MBU 201 is responding to the ONREQ command. The MSTART output indicates that the magnetic bearings have successfully levitated the shaft and are actively controlling its position. The CC 205 interprets the output as an indication that the magnetic bearings are working properly. The remaining digital signal lines connecting the MBU 201 and the CC 205 are used for communicating alarm and warning conditions encountered by the MBU 201. WARN indicates a warning condition has occurred, but does not automatically result in an initiation of the de-levitation sequence. The SDOWN and DSPFAIL lines indicate alarm conditions which result in an automatic emergency shutdown of the MBU 201. An alarm condition results in the initiation of the de-levitation sequence. During a normal de-levitation, the sequence does not start until the shaft is below the minimum speed. During an alarm condition, the de-levitation sequence begins immediately. This can result in machine damage if the shaft is rotating at a high speed when the magnetic bearings begin reducing power to lower the shaft.

FIGS. 1*a* and 1*b*, a schematic diagram of the chiller control system apparatus, shows the electrical and communication interconnections between the major components, (CC,ASD,MBU). Because both the MBU 201 and the ASD 202 components must be operating properly for the compressor to operate safely without damage to the machine at high speeds, the control lines for both components have been interconnected with the control signals from the CC 205 using boolean logic implemented in the solid state relay connections.

The ENABLE/QSTOP DI02 line of the CC 205 and the MSTART 209*c* signal of the MBU 201 are connected with a logical AND 213, the output of which is connected to the ENABLE/QSTOP 210*a* line of the ASD 202. Therefore, the ASD 202 cannot start the compressor motor if the magnetic bearings are not in controlled levitation. If the compressor motor is running, and an alarm condition in the MBU 201 occurs, the MSTART 209*c* signal is automatically deactivated. In an effort to reduce the speed of the shaft before it contacts the auxiliary bearings, the ASD 202 begins DC injection braking (an emergency stop of the electric motor).

The START/STOP line DI03 of the CC 205 and the WARN line 209*d* of the MBU 201 are connected with a logical AND 223, the output of which is connected to the START/STOP line 210*b* of the ASD 202. Therefore, if a warning condition occurs in the MBU 201 while the compressor motor is running, the ASD 202 begins normal braking to bring the motor to a controlled stop until the warning condition clears. Because the CC 205 is also connected directly to the WARN line 209*d*, it has the option of automatically restarting the compressor motor or delaying restart for a preprogrammed length of time.

The READY/REMOTE line 211*b* of the ASD 202 and the ONREQ line DI05 of the CC 205 are connected with a logical AND 212, the output of which is connected to the ONREQ line 208*b* of the MBU 201. Therefore, the bearings cannot be levitated until the ASD 202 is operating properly, thus preventing undue consumption of electrical power and undue heating in the magnetic bearings.

The microprocessor chiller controller runs a computer algorithm that performs the sequence of actions necessary to start and stop the chiller, monitor the current operating condition, record operating data and run a graphical user interface to display conditions to the user. A software program contains the graphical user interface (GUI) which communicates with the user and allows the user to monitor operating data when the chiller is running. Its algorithm acquires the operating data, checks for alarms and warnings, calculates the chiller cooling capacity, determines the parameters for position of the inlet guide vanes to match measured capacity with desired capacity and updates the operating history log. The program provides PID control of the compressor speed, inlet guide vane angle, and diffuser vane angle.

Shown in FIG. 5 are variables which are defined for the algorithm according to the invention. Here, the control variables are the variables which the chiller control system can adjust to track the cooling load while at the same time maximizing chiller efficiency and avoiding compressor surge. The three primary control variables are the compressor speed (N), the inlet guide vane angle (IGV), and the diffuser vane angle (DIF). Each primary control variable has an associated adjustment variable which determines the change in the control variable in response to changes in system performance. These are respectively the compressor speed adjustment (dN), the inlet guide vane angle adjustment (dIGV), and the diffuser vane angle adjustment (dDIF). The control variables include a PID subroutine, denoted by PID( ), which executes a traditional PID control strategy of the type well known in the art to adjust the inlet guide vane angle to control leaving water temperature.

The operating state variables define the current operating state of the centrifugal compressor from measured temperatures, pressures and/or flow rates within the chiller. These variables include the non-dimensional pressure coefficient (PC) defined for a centrifugal compressor as, $$\psi = \frac{\Delta p}{\rho N^2 D_2^2}$$

and a non-dimensional efficiency coefficient (EC) which represents the isentropic efficiency defined for a centrifugal compressor as $$\eta = \frac{h_{2s} - h_1}{h_2 - h_1}$$

The operating state variables include a surge subroutine, denoted by S( ) that calculates a surge pressure coefficient (PCs) and a surge flow coefficient (FCs) that lie on the surge line at points near the actual current operating pressure coefficient (PC) and flow coefficient (FC). These non-dimensional coefficients are compared to a compressor operating map, a plot of pressure coefficient versus flow coefficient behavior (described earlier) generated from experimental test data. The surge line on the compressor operating map is represented by a best fit equation.

For the chiller control system apparatus according to the invention, the oscillations in the electrical current are used to indicate surge. By periodically sampling the electrical current, a standard deviation of the sampled measurements can be determined quickly. When the standard deviation exceeds a predetermined value, the compressor is understood to be operating in a surge condition. The larger the standard deviation of the sampled data, the larger the variation of the electrical current around some mean value.

The plant variables define the desired, actual and acceptable operating conditions for the chiller. The centrifugal chiller control system works to maintain the measured chiller leaving evaporator water temperature (LWTm) within a small temperature band (LWTb) centered around a preprogrammed setpoint temperature (LWTs) which is dependent on the requirements of the attached the building air conditioning system or process cooling system. The leaving water temperature error (LWTe) is the difference between the measured leaving water temperature and the leaving water temperature setpoint. The changes in building or process cooling load are reflected in changes in the chiller entering evaporator water temperature. When the entering evaporator water temperature increases (increased cooling load), the chiller must increase its cooling capacity in order to cool the incoming water to the desired leaving evaporator water temperature. Conversely, when the entering evaporator water temperature decreases (decreased cooling load), the chiller must decrease its cooling capacity in order to avoid cooling the incoming water below the desired leaving evaporator water temperature. The control system always works to maintain the measured leaving water temperature (LWTm) in the error band (LWTb) around the leaving water temperature setpoint (LWTs).

The chiller control system algorithm may work to minimize either the calculated isentropic efficiency of the compression process or the measured real mechanical efficiency (kW/ton) of the compressor. The chiller control system adjusts the control variables in order to match the output with the plant variable. The iteration counters are used to keep track of the number of iterations through various subroutines within the chiller control system. These iteration counters act as built in delays, allowing the chiller to reach a steady state condition before additional adjustments are made in order to bring the plant variables to the desired point. The speed adjustment background counter (BN) is used to determine the number of iterations through various subroutine components before an attempt to reduce speed to improve operating efficiency is attempted. The diffuser adjustment background counter is used to determine the number of iterations through various subroutine components before an attempt to change diffuser vane angle to improve operating efficiency is attempted.

The operating flags indicate current conditions within the chiller control system based on decisions made by the chiller control system algorithm. The RANGE flag indicates whether the measured leaving water temperature is within the desired error band around the leaving water temperature setpoint. The RUN flag indicates whether the chiller compressors are running. The ALARM flag indicates whether an alarm condition was encountered in any part of the chiller system including the chiller sensors, the magnetic bearing control unit, or the adjustable speed motor drive. The SURGE flag indicates that a compressor surge condition was encountered. The detection of surge may be determined from standard deviations of the measured electrical currents in the motor windings, or from monitoring bearing conditions. The speed reduction flag (NoNDEC) is used to signal that no other reductions in compressor speed are allowed in order for the chiller to reach steady state condition and to prevent surge. The IDAD and AND mode flags are used to indicate the subroutines to provide primary control to the centrifugal chiller.

The miscellaneous variables (for example, gain factors) are used to approximately relate the changes in one control variable with an equivalent change in another critical control variable. The IGV/N gain factor (GIGV-N) converts an adjustment of in let guide vane position to an equivalent adjustment of the compressor speed. The IGV/DIF gain factor (GIGV-DIF) converts an adjustment of inlet guide vane position into an equivalent adjustment of the diffuser vane position.

Figure 6A:
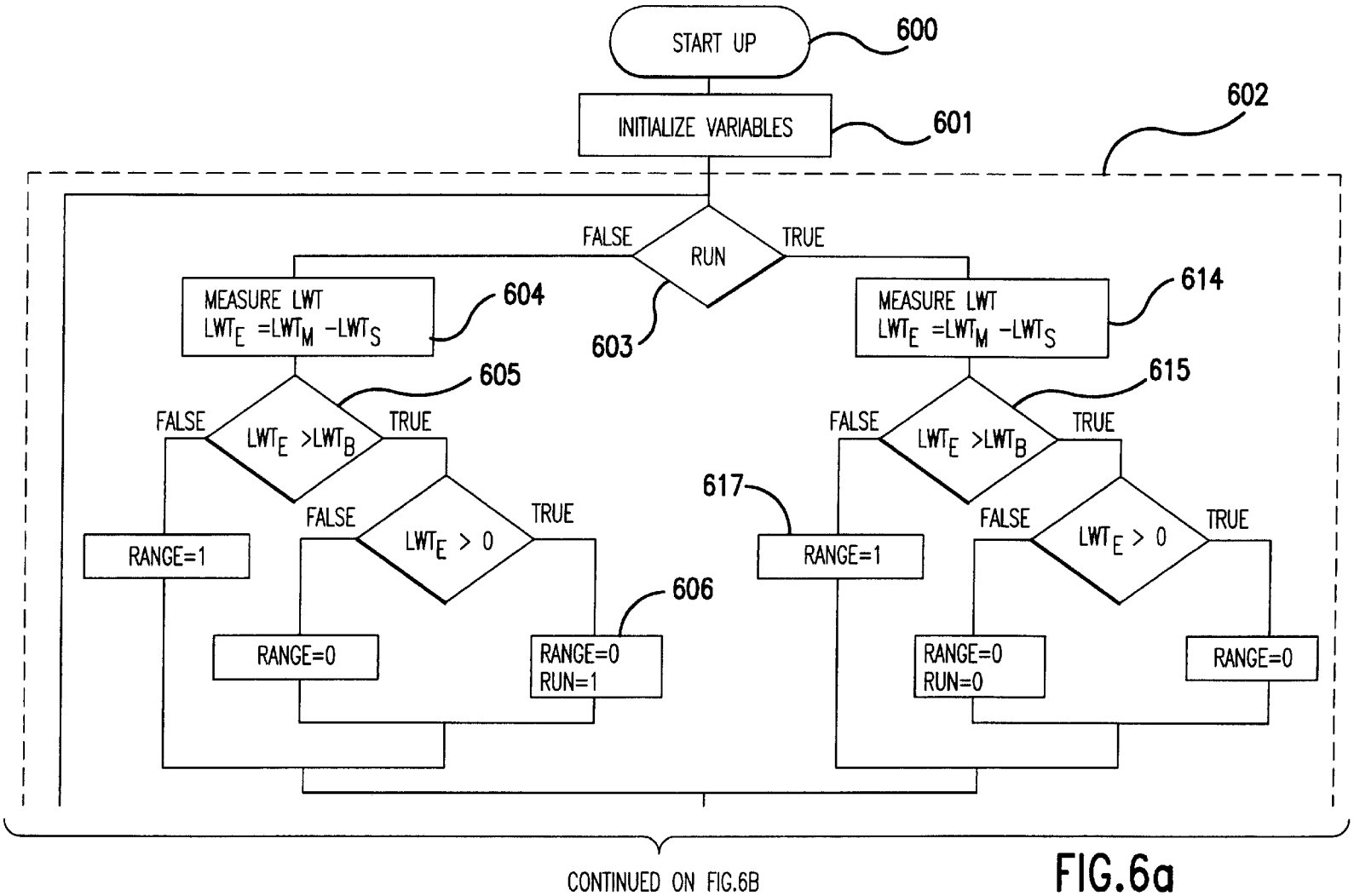
FIGS. 6*a* and 6*b* are flow chart showing the main control subroutine of the chiller control system algorithm according to the invention.
Figure 6B:
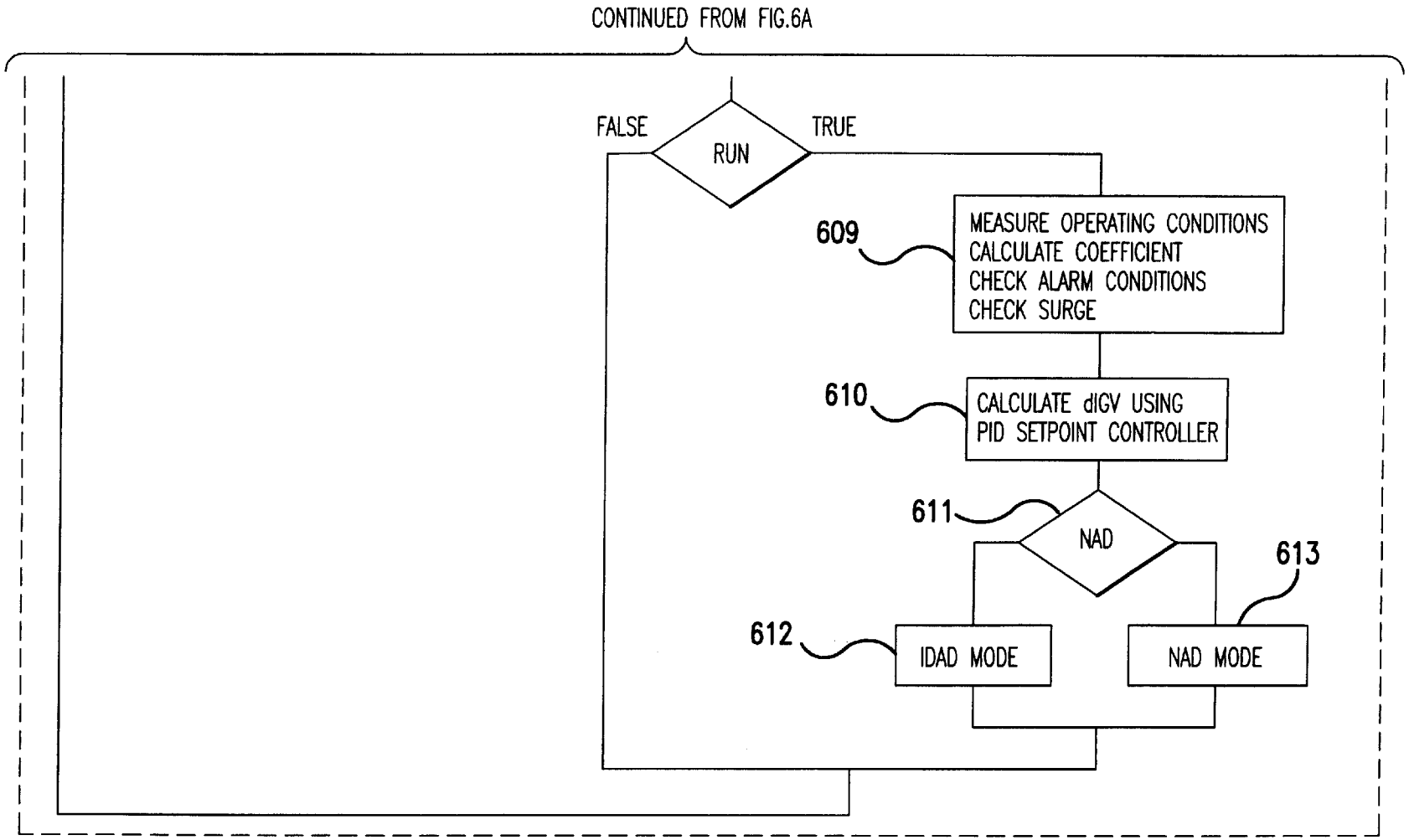

FIGS. 6*a* and 6*b* show the main chiller control system subroutine which begins at START UP 600, when the chiller control system is powered up electrically. Following the initialization of all program variables and routine checks of all chiller sensors and communications connections in step 601, the chiller control system algorithm enters the main chiller control system loop surrounded by dashed box 602.

In step 603, the chiller control system assesses its current operating state to determine whether the chiller is running. If the chiller is not running and within range the chiller remains off. If the chiller is not running and the leaving water temperature error, measured in step 604, exceeds the leaving water temperature error band, compared in step 605, the chiller operating state is changed, step 606, and the chiller compressors undergo a startup procedure (not shown). The chiller control system according to the invention measures the current leaving water temperature and calculates the error (LWTe) between the leaving water temperature measurement (LWTm) and the leaving water temperature setpoint (LWTs). If the error is greater than the acceptable error band (LWTb) around the leaving water temperature setpoint, then the chiller control system algorithm sets the range (RANGE) flag to false, thus indicating that the chiller is not operating in steady state. This assumes that the leaving water temperature measurement is above the leaving water temperature setpoint. If the leaving water temperature measurement is below the leaving water temperature setpoint, then the system does not start the compressor. The system then measures the entering water temperature and flow rate to determine that there is a thermal load on the system. If a load exists, the control system sets the load (LOAD) flag to true and sets the centrifugal compressor run (RUN) flag to true indicating that the compressor must be running.

If the chiller is running and within range the chiller remains on. If the chiller is running and the leaving water temperature error, measured in step 614, exceeds the leaving water temperature error band, compared in step 615, the chiller operating state is changed, step 617, and the chiller compressors undergo a shutdown procedure (not shown).

The chiller control system levitates the magnetic bearings and accelerates the compressor speed to the design speed ($N_{DES}$) with the inlet guide vane angle ($IGV_{DES}$) and diffuser vane angle set to the design operating point ($DIF_{DES}$) This operating point for the chiller is below the maximum lift temperature expected to be seen by the chiller. The design point represents the point of maximum isentropic efficiency for the compressor. At this point, the cooling capacity of the chiller at the design point may be less than or greater than that required to match the cooling load.

On the first iteration through the main chiller control system loop, the angle adjustment flag (IDAD) is initialized to true in step 601, (and the speed adjustment flag (AND) is initialized to false) indicating that the inlet guide vanes and/or diffuser vanes can be adjusted by the PID control algorithm to match cooling capacity with cooling load. During the initialization step, the iteration counters ($C_{LWT}$, $C_{IGV}$, $C_{DIV}$) are set to zero. During successive passes through the main chiller control system loop denoted by box 602, the states of the IDAD and the AND flags and the iteration counters are changed in the IDAD and AND mode subroutines.

In general terms, capacity control for the chiller is accomplished by varying the compressor speed, inlet guide vane position, and diffuser vane position simultaneously. In step 609, the chiller control system acquires operating data from the chiller sensors, the adjustable speed motor drive, and the magnetic bearing control unit. The operating data are used to assess the current state of the chiller. Calculated estimates of heat load, heat rejection, estimated isentropic and machine kW/ton efficiencies, and refrigerant thermal properties are made by the chiller control system. The refrigerant properties are used to calculate the non-dimensional performance coefficients, (PC, FC, EC) which are used to determine the current operating state of the compressor on an experimentally determined compressor operating map. The data are used to check alarm conditions that could typically damage chiller equipment, such as low evaporating temperature, high condensing pressure, low line voltage, or magnetic bearing control problems. On discovery of an alarm condition, the chiller control system takes the appropriate action. The chiller control system performs a surge check by measuring the standard deviation of a series of line current measurements.

In step 610, the current operating state measurements are fed to a PID controller subroutine of the type commonly known in the art. The controller subroutine modulates the control variable (inlet guide vane angle) to reduce the leaving evaporator water temperature error (LWTe) to zero. The output of the PID controller subroutine is an adjustment of the current inlet guide vane angle (dIGV) that will reduce the leaving evaporator water temperature error.

Following the estimate of the inlet guide vane adjustment made by the PID controller in step 610, the main chiller control system loop passes control of the chiller to either the angle adjustment mode subroutine (IDAD) in step 612 or the speed adjustment mode subroutine (AND) in step 613 depending on the settings of the IDAD and AND mode flags tested in step 611.

Figure 7A:
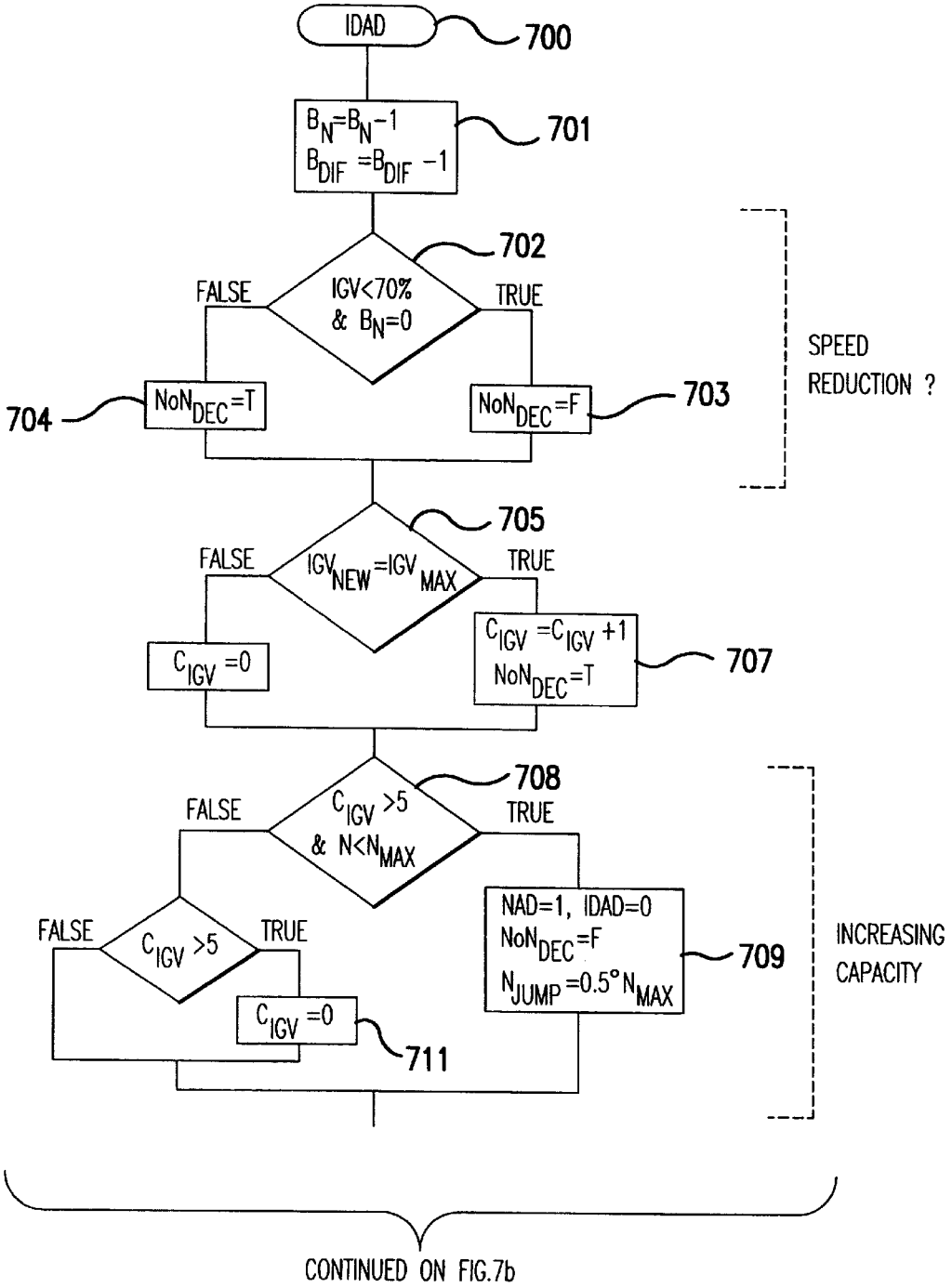
FIGS. 7*a* and 7*b* are flow chart of the IDAD control subroutine of the chiller control system algorithm according to the invention.
Figure 7B:
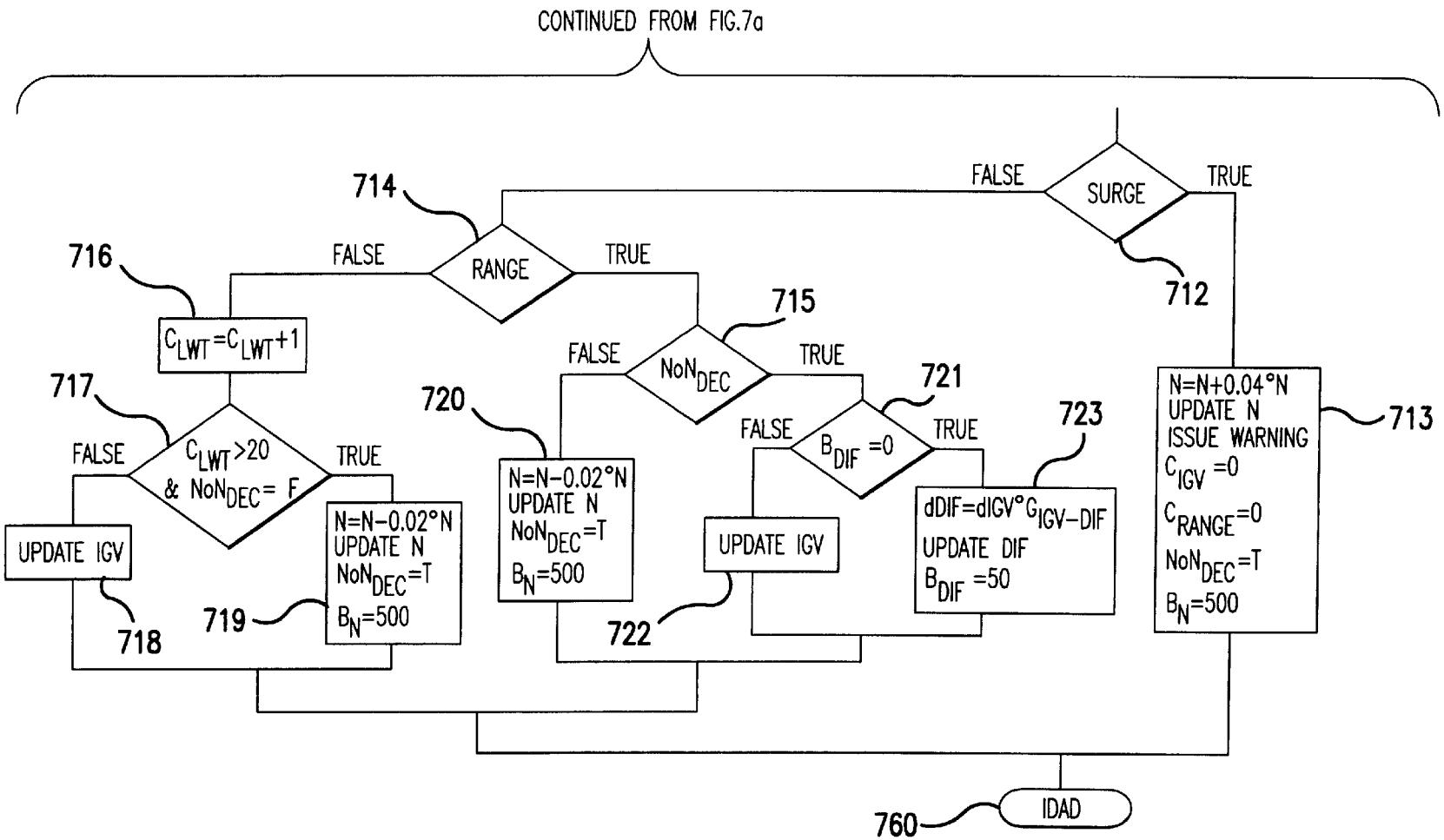

In the angle adjustment mode (IDAD) subroutine, a flowchart of which is shown in FIGS. 7*a* and 7*b*, inlet guide vane angle, diffuser vane angle, and compressor speed can be adjusted to maximize chiller efficiency. When chiller control transfers to the IDAD mode subroutine started in step 700 of FIGS. 7*a* and 7*b*, both the background speed adjustment and the background diffuser angle adjustment counters are decremented. The initial values of these counters are set during the initialization step 601 and are reset as necessary in the body of both the IDAD mode and AND mode subroutines. When the counters reach zero, further attempts are made to improve the efficiency of the chiller by either reducing speed or adjusting diffuser vane position. The magnitude of the iteration counter determines the delay between successive attempts to improve operating efficiency. The larger the counter value, the longer the time period between successive adjustments of the secondary diffuser vane (DIF) and operating speed (N) control variables. The primary control variable is the inlet guide vane angle (IGV).

In step 702, the chiller control system determines whether the inlet guide vanes are less than 70 percent of their full open position and whether the speed adjustment backgound counter has been reduced to zero. If both conditions are satisfied, the speed reduction flag is set to false, step 703, indicating that the chiller control system can reduce compressor speed in order to improve operating efficiency. When the inlet guide vanes are above 70 percent of fully open position, reductions in compressor speed to improve efficiency could potentially create a surge condition within the chiller. Therefore, when the inlet guide vanes are beyond 70% of the full open position, further speed reductions are prevented by setting the speed reduction flag to true, step 704.

In step 705, the chiller control system determines whether the inlet guide vane adjustment recommended by the PID control subroutine positions the inlet guide vanes at the maximum open position. If the inlet guide vanes are at maximum open position, then the inlet guide vane interation counter is incremented in step 707 and the speed reduction flag is set to true to prevent speed reductions from leading to a surge condition.

In step 708, the chiller control system determines whether the inlet guide vane have been positioned at their maximum open position for a predefined number of iterations. If the guide vanes are at the maximum open position and the chiller is running at less than maximum operating speed, then the cooling capacity of the chiller is less than that required by the cooling load at the current operating speed. As a result, in step 709, the chiller control system resets the IDAD and AND mode flags so that on the next iteration through the main chiller control system loop 602, the chiller control system will pass control to the AND mode subroutine so that it can increase speed to generate greater cooling capacity for the chiller. If the inlet guide vane are at maximum open position and the compressor is operating at full speed, the chiller cooling capacity has reached a maximum and the inlet guide vane counter is reset in to zero in step 711 to prevent oscillation between the IDAD and AND operating modes.

In step 712, the chiller control system algorithm performs a surge check. In the event that a surge event is detected, the chiller control system immediately in step 713 increases the compressor operating speed by 4%, issues a warning to the machine user, sets the speed reduction flag to true preventing further reductions in compressor speed, and resets the compressor speed background counter to reset the time delay between successive attempts by the chiller control system to reduce compressor speed to improve efficiency and reduce electric power consumption. The IDAD subroutine returns control of the chiller to the main chiller control system loop at step 760.

In step 714, the control system checks to see if the RANGE flag has been set and the leaving evaporator water temperature is within range. If the leaving evaporator water temperature is not within range, the the control system increments the leaving water temperature range counter (CLWT) in step 716. This counter keeps track of the number of successive iterations through the IDAD subroutine in which the leaving evaporator water temperature is not in range. If the number of leaving water temperature range counter does not exceed 20 or the speed reduction flag has been set to true, tested in step 717, then the chiller control system updates the IGV control variable in step 718 according to the amount predicted by the PID control subroutine.

If the leaving water temperature range counter exceeds 20 and the speed reduction flag has been set to false, then the chiller control system reduces the compressor speed by approximately 2% in step 719. The speed reduction reduces the cooling capacity of the chiller when the cooling capacity exceeds the cooling load. Step 719 will never be reached if the cooling load exceeds the current chiller cooling capacity because the inlet guide vanes must be less than 70 percent of the fully open position in step 702 in order to set the speed reduction flag to false.

If the leaving evaporator water temperature is within range, RANGE has been set to true, the chiller control system assesses the current state of the speed reduction flag in step 715. If the speed reduction flag has been set to false, the control system reduces the compressor by 2% in step 720. The chiller control system also resets the speed adjustment background counter. When the algorithm reaches step 720, the chiller control system is reducing compressor speed in order to improve isentropic efficiency.

If the speed reduction flag has been set to true, the chiller control system checks the current state of the diffuser vane adjustment background counter in step 721. If the counter has been reduced to zero, then the diffuser vane control variable (DIF) is adjusted and updated and the diffuser vane adjustment counter is reset in step 723. If the diffuser vane adjustment counter has not been reduced to zero, then the inlet guide vane control variable (IGV) is adjusted and updated in step 722. The diffuser vane control variable is adjusted at much less frequent intervals and in much smaller steps than the inlet guide vane control variable. The ratio of the adjustments is determined by the initial programmed value of the diffuser vane adjustment background counter.

The compressor speed adjustment background counter determines the frequency of attempts by the chiller control system to reduce compressor speed without causing a compressor surge or without allowing the measured leaving evaporator water temperature to leave the desired leaving evaporator water temperature range. Typically the adjustments in compressor speed occur on a less frequent basis than adjustments in diffuser vane angle and inlet guide vane angle.

On exit of the IDAD mode subroutine at step 760, control of the chiller returns to the main chiller control system loop 602 which repeats its execution at step 603 with the determination of the current compressor operating state.

Figure 8A:
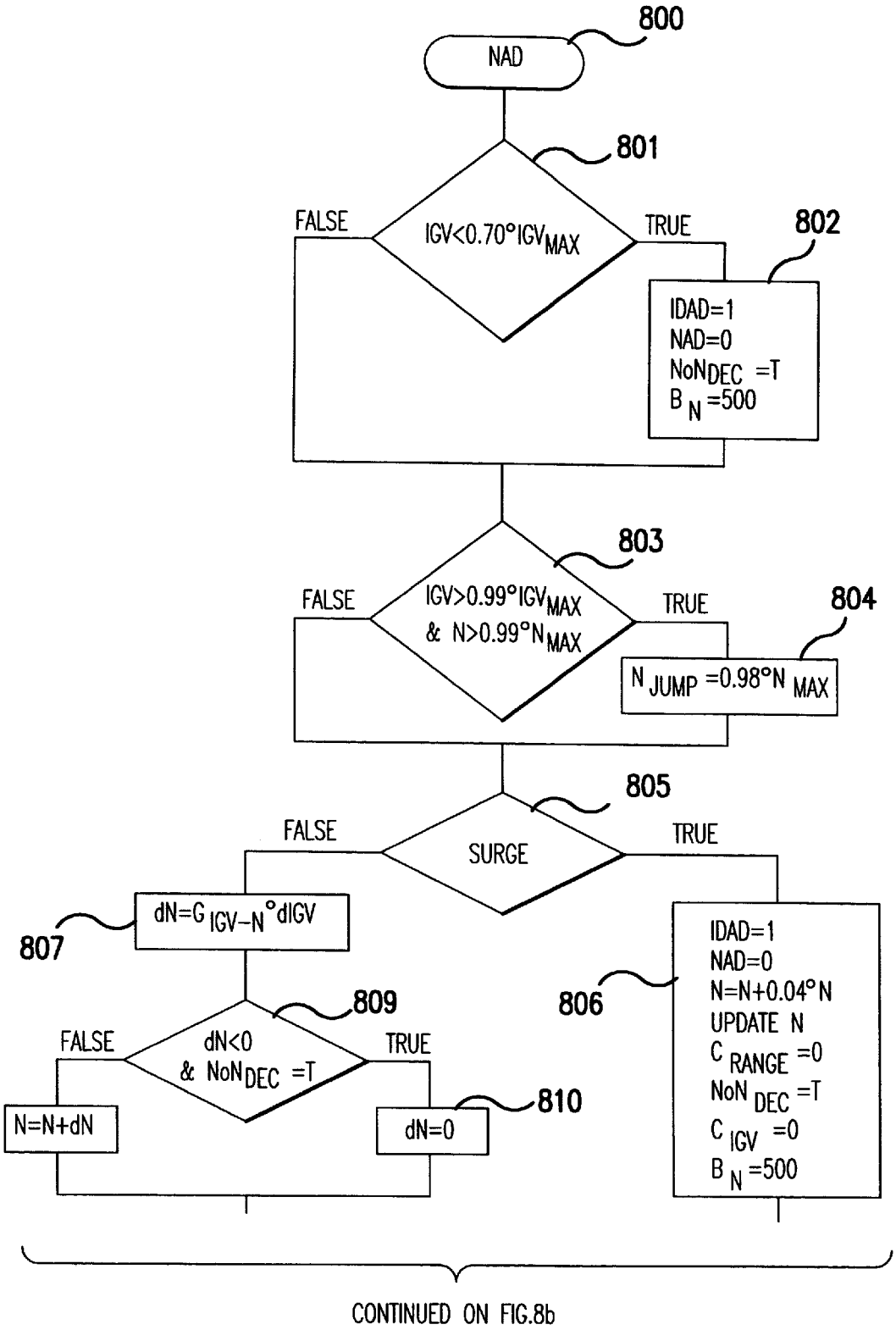
FIGS. 8*a* and 8*b* are flow chart of the AND control subroutine of the chiller control system algorithm according to the invention.
Figure 8B:
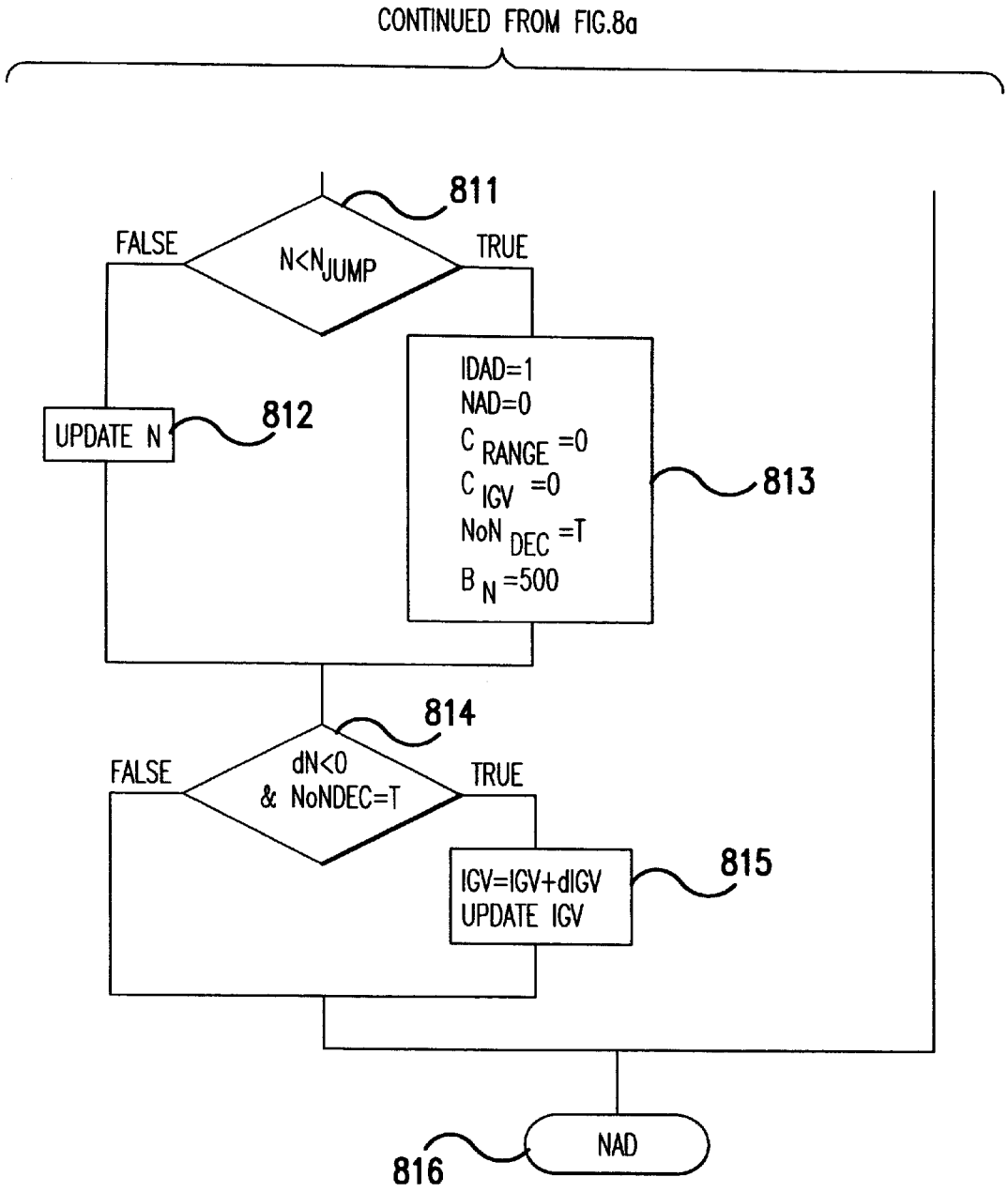

In the NAD mode subroutine, execution starts at step 800 in FIGS. 8*a* and 8*b*. The chiller control system tests to determine whether the inlet guide vanes are less than 70% of the maximum open position in step 801. If the vanes are less than 70% of the maximum open position, the chiller control system resets the IDAD and AND mode control flags to return control of the chiller to the IDAD routine on the next iteration through the main chiller control system loop in step 802. It also resets the speed adjustment background counter and the speed reduction flag. The IDAD loop algorithm improves the efficiency of operation of the compressor by driving the inlet guide vanes toward the open position with the centrifugal compressor operating at the lowest speed possible that still avoids a surge condition.

In step 803, the subroutine checks to see if the inlet guide vane are near the maximum open position while at the same time the compressor speed is near the maximum design operating speed. If the compressor operating speed is near the design maximum while the inlet guide vanes are near the fully open position, then the chiller is operating at the near its maximum cooling capacity. The subroutine resets the transition compressor speed variable. The transition compressor speed is the compressor speed at which control of the chiller is returned to the IDAD mode subroutine. If the compressor speed falls below the transition compressor speed then control is returned to the IDAD mode subroutine.

In step 805, the chiller control system algorithm performs a surge check. In the event that a surge event is detected, the chiller control system immediately in step 806 increases the compressor operating speed by 4%, issues a warning to the machine user, sets the speed reduction flag to true preventing further reductions in compressor speed, and resets the compressor speed background counter to reset the time delay between successive attempts by the chiller control system to reduce compressor speed to improve efficiency and reduce electric power consumption. In addition, the IDAD and AND mode variables are reset to return control on the next iteration through the main chiller control system loop to the IDAD mode subroutine.

In step 807, the inlet guide vane angle adjustment determined by the PID control algorithm is multiplied by a gain factor to calculate its equivalent compressor speed adjustment to produce the equivalent effect. Using modern computer microprocessors, the execution time for one iteration through the main chiller control system loop is approximately 2 seconds. Therefore the inlet guide vane adjustments and speed adjustments necessary to track small changes in cooling load are also fairly small.

In step 809 the chiller control system checks if the requested speed adjustment calculated previously results in a reduction of the compressor speed. If the speed reduction flag has been set to true in a prior conditional statement, the speed adjustment is reset to 0 in step 810. This prevents the reduction in compressor speed that could potentially lead to a surge condition.

In step 811, the chiller control systems compares the speed control variable (N) to the transition compressor speed. If the speed control variable is above the compressor speed, the speed adjustment is updated in step 812. If the speed control variable is below the transition compressor speed, then the IDAD and AND mode flags are rest to transfer control of the chiller to the IDAD subroutine in step 813.

In step 814, the chiller control system tests to see if the speed reduction flag is set to true while the speed adjustment is less than zero. If the speed reduction flag is true, then the control system does not update the compressor speed but changes the inlet guide vane angle position.

The NAD mode subroutine transfers control back to the main chiller control system loop in step 816.

After achieving steady state, successive attempts are made to increase efficiency by reducing the compressor speed and hence reducing motor power consumption. The optimum operating point occurs where the speed has been reduced to the minimum speed that will produce the required pressure difference across the impeller for a given cooling load. Reduction of speed below this point will cause unsteady surge conditions that must be avoided. Real dynamic surge conditions and a surge boundary curve may be plotted on a non-dimensional compressor map of pressure coefficient versus flow coefficient. If the surge boundary curve is sufficiently distant from the real surge conditions, the compressor may be safely operated at points outside the boundary curve. A surge condition is detected by measuring the standard deviation of the motor current. If the controller detects surge conditions, the speed is immediately increased by a set increment.

NAD mode operation initially increases the speed of the compressor to match the increase in the cooling load detected by a change in LWT. Subsequent speed reductions may also occur. All speed changes in this mode are proportional to the change in the inlet guide vane position requested by the PID controller.

Transfer from AND mode to IDAD mode will occur if: a surge condition is detected, the speed is modulated below 50% of the maximum compressor speed, or the compressor speed is modulated below 98% of the maximum speed following conditions where the chiller could not meet the cooling load demands. FIG. 11 shows an example of the source code for the AND mode subroutine.

The magnetic bearing centrifugal compressor, because it uses an ASD to control motor speed, has the advantage of using a second control method to meet the aggregate cooling load that across the line started centrifugal compressors do not. When the temperature lift and flow rate requirements for meeting the cooling load are such that, even with both inlet guide vanes and a variable geometry diffuser the compressor cannot avoid operating in a surge condition, a second control strategy can be employed.

In this control strategy, the compressor is cycled, using a variable duty cycle that is determined by the compressor control system, between two different operating points that do not lie within the surge operating condition. The manner of operation is very similar to the operation of home air conditioners which cycle on and off to maintain the room temperature within a fixed temperature deadband around a preset temperature point.

Essentially, when the temperature rises above the upper limit of the temperature deadband around the desired leaving water temperature, the compressor operates in the high speed condition where the cooling capacity exceeds that required to meet the instantaneous cooling load. As a result, the leaving water temperature begins to drop and continues to drop until it reaches the lower limit of the temperature deadband around the desired leaving water temperature setpoint. At this point, the compressor speed is reduced to the low speed condition where the cooling capacity drops nearly to zero. In this condition, the condensing temperature of the refrigerant drops below the temperature of the external thermal control system. Only the sensible portion of the heat that is above the temperature of the external thermal control system can be rejected.

FIGS. 9(*a*) thru 9(*c*) show an example of the source code for implementing the main program. FIGS. 10(*a*) and 10(*b*) show an example of the source code for implementing the angle adjustment subroutine. FIG. 11 shows an example of the source code for implementing. the speed adjustment subroutine.

The existence of a MBU 201 and a chiller control system which receives inputs or outputs from the MBU 201 is regarded as the realization of the invention, irrespective of the existence of an ASD as part of the control system. The existence of a touchscreen display or a screen capable of complex graphics is considered a realization of another unique feature of this invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A centrifugal cooling apparatus comprising:

at least one of an evaporator, a centrifugal compressor having a magnetic bearing system, a condenser, and an expansion device, wherein the centrifugal compressor has an adjustable speed motor; and a control unit configured to provide flow stability based upon an operating condition of the magnetic bearing system.

2. The apparatus according to claim 1 further comprising a magnetic bearing sensor, wherein the operating condition of the magnetic bearing system is an output from the magnetic bearing sensor.

3. The apparatus according to claim 2, where the output from the magnetic bearing sensor is a bearing position output, a bearing stabilizing current, or a bearing stabilizing power level.

4. The apparatus according to claim 3, where the control unit is configured to turn the compressor motor off and on to adjust the output level of the cooling apparatus.

5. The apparatus according to claim 1, wherein the flow stability is controlled by adjusting a speed of the motor.

6. The apparatus according to claim 5, wherein the control unit is configured to maintain the speed of the motor as low as possible without encountering flow instability.

7. The apparatus according to claim 1, wherein the centrifugal compressor includes adjustable guide vanes.

8. The apparatus according to claim 7, wherein the flow stability is controlled by adjusting the adjustable guide vanes.

9. The apparatus according to claim 8, wherein the adjustable guide vanes include inlet guide vanes and diffuser guide vanes, and the apparatus further comprises a positioning device for monitoring and controlling the angular position of the inlet guide vanes, and a positioning device for monitoring and controlling the angular position of the diffuser guide vanes.

10. The apparatus according to claim 1, wherein a single control unit is configured to provide flow stability based upon a single operating condition of the magnetic bearing system.

11. A centrifugal cooling apparatus comprising:

a centrifugal compressor having a rotor and an adjustable speed motor used to drive the rotor;

a magnetic bearing system supporting the rotor; and a control unit configured to control the speed of the motor, the control unit being configured to provide compressor flow stability based on a parameter related to the operating condition of the magnetic bearing system.

12. The apparatus according to claim 11, wherein the parameter is a bearing position, a bearing stabilizing current, or a bearing stabilizing power level.

13. The apparatus according to claim 11, wherein the flow stability is controlled by adjusting the speed of the motor.

14. The apparatus according to claim 13, wherein the control is configured to maintain the speed of the motor as low as possible without flow instability.

15. The apparatus according to claim 11, wherein the centrifugal compressor comprises adjustable guide vanes, and the flow stability is controlled by adjusting the adjustable guide vanes.

16. The apparatus according to claim 15, wherein the adjustable guide vanes include inlet guide vanes and diffuser guide vanes, and the apparatus further comprises a positioning device for monitoring and controlling the angular position of the inlet guide vanes, and a positioning device for monitoring and controlling the angular position of the diffuser guide vanes.

17. The apparatus according to claim 11, wherein the control unit is configured to turn the motor off and on to adjust the output level of the cooling apparatus.

18. A centrifugal cooling apparatus comprising:

a control system;

a centrifugal compressor having a magnetic bearing system; and an active magnetic bearing control unit operatively associated with the control system for maintaining flow stability based on a condition of the magnetic bearing system.

19. The apparatus according to claim 18, wherein the control system and control unit are operatively arranged to maintain speed of the centrifugal compressor as low as possible without encountering flow instability.

20. The cooling apparatus according to claim 18, wherein the centrifugal compressor is configured to be turned on and off for controlling the capacity of the cooling apparatus.

21. The apparatus according to claim 18, wherein a single active magnetic bearing control unit is configured to maintain flow stability based on a single condition of the magnetic bearing system.

* * * * *